US011292636B2

(12) United States Patent
Campbell et al.

(10) Patent No.: US 11,292,636 B2
(45) Date of Patent: Apr. 5, 2022

(54) PROTECTIVE BOTTLE ENCLOSURE

(71) Applicant: BottleKeeper, LLC, Houston, TX (US)

(72) Inventors: Matthew T. Campbell, Cave Creek, AZ (US); Kevin Stern, Cook, MN (US)

(73) Assignee: BottleKeeper, LLC, Houston, TX (US)

( * ) Notice: Subject to any disclaimer, the term of this patent is extended or adjusted under 35 U.S.C. 154(b) by 0 days.

(21) Appl. No.: 16/550,981

(22) Filed: Aug. 26, 2019

(65) Prior Publication Data

US 2019/0375548 A1 Dec. 12, 2019

Related U.S. Application Data

(63) Continuation-in-part of application No. 16/154,550, filed on Oct. 8, 2018, now Pat. No. 10,464,712, which
(Continued)

(51) Int. Cl.
*B65D 81/38* (2006.01)
*B65D 23/08* (2006.01)
(Continued)

(52) U.S. Cl.
CPC ..... *B65D 23/0885* (2013.01); *A47G 19/2205* (2013.01); *A47G 23/0241* (2013.01);
(Continued)

(58) Field of Classification Search
CPC ..... B65D 43/0225; B65D 41/04; B65D 41/0414; B65D 23/0885; B65D 1/0246;
(Continued)

(56) References Cited

U.S. PATENT DOCUMENTS 441,228 A 11/1890 Cherbonnier
460,918 A 10/1891 Kraetzer
(Continued)

FOREIGN PATENT DOCUMENTS

CA 2956727 A1 2/2016
DE 4126215 A1 2/1993
(Continued)

OTHER PUBLICATIONS

Back2Tap, [online], Reusable Bottles posted on Jan. 6, 2011, retrieved on Jan. 28, 2019. Retrieved from, <URL: http://www.back2tap.com/tag/stainless-steel-water-bottles/>, 3 pages.
(Continued)

*Primary Examiner* — Don M Anderson
*Assistant Examiner* — Elizabeth J Volz
(74) *Attorney, Agent, or Firm* — Quarles & Brady LLP

(57) ABSTRACT

A protective bottle enclosure includes a container having a neck, a shoulder, and a body, wherein the neck includes a plurality of threaded portions and a plurality of planar portions located intermediate the plurality of threaded portions. The enclosure further includes a removable cap from which extends a first threaded portion and a second threaded portion, the first and second threaded portions being located along opposing sides of the sidewall, and a first planar portion and a second planar portion disposed adjacent and between the first and second threaded portions. The first and second threaded portions of the cap are aligned with the plurality of planar portions along the neck when the cap is axially inserted into the container.

20 Claims, 16 Drawing Sheets

Related U.S. Application Data is a continuation of application No. 15/584,013, filed on May 1, 2017, now Pat. No. 10,118,735, which is a continuation of application No. 15/362,540, filed on Nov. 28, 2016, now Pat. No. 9,637,270, which is a continuation of application No. 14/153,688, filed on Jan. 13, 2014, now Pat. No. 9,505,527.

(60) Provisional application No. 61/752,404, filed on Jan. 14, 2013.

(51) Int. Cl.

| | |
|---|---|
| ***B65D 43/02*** | (2006.01) |
| ***B65D 41/04*** | (2006.01) |
| ***B65D 1/02*** | (2006.01) |
| ***A47G 19/22*** | (2006.01) |
| ***A47G 23/02*** | (2006.01) |
| ***B65D 81/02*** | (2006.01) |
| *B65D 25/24* | (2006.01) |

(52) U.S. Cl.

CPC ..... *B65D 1/0246* (2013.01); *B65D 1/0261* (2013.01); *B65D 41/04* (2013.01); *B65D 41/0414* (2013.01); *B65D 43/0225* (2013.01); *B65D 81/02* (2013.01); *B65D 81/3876* (2013.01); *H05K 999/99* (2013.01); *A47G 23/02* (2013.01); *B65D 25/24* (2013.01); *B65D 81/3879* (2013.01); *B65D 81/3888* (2013.01)

(58) Field of Classification Search

CPC ..... B65D 1/0261; B65D 25/24; B65D 81/02; B65D 81/3876; B65D 81/3879; B65D 81/3888; A47G 21/18; A47G 19/2266; A47G 19/2205; A47G 23/0241; A47G 23/02

USPC ..... 220/288, 293, 296; 215/44

See application file for complete search history.

(56) References Cited

U.S. PATENT DOCUMENTS 1,351,496 A * 8/1920 Spooner ..... B65D 41/04 215/329
2,163,568 A 6/1939 Schlumbohm
2,889,065 A 6/1959 Lawlor
2,963,187 A 12/1960 Bramming
3,120,319 A 2/1964 Buddrus
3,229,840 A 1/1966 Filleul
3,241,209 A * 3/1966 Taylor ..... B65D 23/0885 215/13.1
3,308,980 A 3/1967 Taylor
3,335,891 A 8/1967 Bailey
D216,386 S 12/1969 Suggs
4,245,753 A * 1/1981 Ellis ..... B44D 3/12 215/318
4,444,324 A 4/1984 Grenell
4,510,769 A 4/1985 McClellan, Jr.
D279,346 S 6/1985 Ruxton
4,690,300 A 9/1987 Woods
4,768,664 A 9/1988 Zimmermann
4,811,858 A * 3/1989 Augur ..... B65D 81/3886 215/13.1
4,823,974 A 4/1989 Crosser
D321,628 S 11/1991 Kobayashi et al.
5,186,350 A 2/1993 McBride
5,213,215 A 5/1993 Prevot
5,261,554 A 11/1993 Forbes
5,417,327 A 5/1995 Saumure
5,635,232 A 6/1997 Wallace
5,695,090 A 12/1997 Burdick
5,745,626 A 4/1998 Duck et al.
5,904,267 A 5/1999 Thompson
D410,548 S 6/1999 Chomik
5,975,337 A 11/1999 Hadley
5,992,677 A 11/1999 Ebine
6,427,863 B1 8/2002 Nichols
6,467,644 B1 10/2002 Veh
6,604,649 B1 8/2003 Campi
D495,208 S 8/2004 Putnam
6,793,076 B1 9/2004 Luo et al.
D512,874 S 12/2005 Poulson et al.
D533,396 S 12/2006 Lipson
D543,791 S 6/2007 Goto et al.
D547,610 S 7/2007 Edelstein et al.
D553,914 S 10/2007 Wahl
D573,390 S 7/2008 Ablo
D578,390 S 10/2008 Green
D586,186 S 2/2009 Bhavnani
D599,616 S 9/2009 Cresswell et al.
D604,561 S 11/2009 Chisholm
D614,918 S 5/2010 Chisholm
D615,823 S 5/2010 Gilbert
D616,743 S 6/2010 Cresswell et al.
D619,418 S 7/2010 Nezu et al.
D620,798 S 8/2010 Cresswell et al.
D621,220 S 8/2010 Lown et al.
D621,257 S 8/2010 Gullickson et al.
D624,362 S 9/2010 Wahl
D626,416 S 11/2010 Cresswell et al.
D627,227 S 11/2010 Andis
D627,601 S 11/2010 Eyal
D628,486 S 12/2010 Lane
D632,522 S 2/2011 Wahl et al.
D632,524 S 2/2011 Rosbach et al.
D633,338 S 3/2011 Rosbach et al.
D635,457 S 4/2011 Lane
D640,494 S 6/2011 Frederiksen
D648,984 S 11/2011 Gullickson et al.
D651,853 S 1/2012 Eyal
D652,255 S 1/2012 Carland
D652,682 S 1/2012 Eyal
D653,081 S 1/2012 George
D655,581 S 3/2012 Kotani
D656,025 S 3/2012 Carreno
D657,196 S 4/2012 Beyers, III
D658,450 S 5/2012 Ying
D658,944 S 5/2012 Gilbert et al.
D660,081 S 5/2012 Gilbert
D661,945 S 6/2012 Eyal
D662,767 S 7/2012 Hotell et al.
D664,809 S 8/2012 Eyal
D665,621 S 8/2012 Eyal
D670,525 S 11/2012 Fallon et al.
D672,609 S 12/2012 Aziz et al.
D675,882 S 2/2013 Crockett
D676,708 S 2/2013 Lane
D677,119 S 3/2013 Ying
D680,431 S 4/2013 Hopkins
D682,016 S 5/2013 Knight
D687,677 S 8/2013 Sturgess
D689,332 S 9/2013 Krasner
D691,420 S 10/2013 McIntire
D691,849 S 10/2013 Cetera et al.
D693,170 S 11/2013 Rosbach
D695,069 S 12/2013 Lane
D695,138 S 12/2013 Ball
D696,118 S 12/2013 Lindstrom
D696,900 S 1/2014 George et al.
D696,945 S 1/2014 Newman
D699,516 S 2/2014 Kim et al.
D700,802 S 3/2014 Miller
D700,808 S 3/2014 Eyal
D702,086 S 4/2014 Thurlow
D702,092 S 4/2014 Mettler et al.
D702,506 S 4/2014 Mettler et al.
D705,063 S 5/2014 Weiss
D706,032 S 6/2014 Roth et al.
D710,155 S 8/2014 Tatsukawa
D716,653 S 11/2014 Balembois
D724,385 S 3/2015 Hurley et al.
D725,968 S 4/2015 George

(56) References Cited

U.S. PATENT DOCUMENTS

| | | | |
|---|---|---|---|
| D726,476 | S | 4/2015 | Ercanbrack |
| D727,171 | S | 4/2015 | Marina et al. |
| D727,671 | S | 4/2015 | Gamelli |
| D729,019 | S | 5/2015 | Kilduff et al. |
| D730,729 | S | 6/2015 | George |
| D736,563 | S | 8/2015 | George |
| D737,144 | S | 8/2015 | Hughes et al. |
| D738,692 | S | 9/2015 | Kilduff et al. |
| D740,609 | S | 10/2015 | Ayres |
| D741,655 | S | 10/2015 | Whelan et al. |
| D743,741 | S | 11/2015 | Itzhaki |
| D758,132 | S | 6/2016 | Breit |
| D758,800 | S | 6/2016 | Hayslett et al. |
| D760,081 | S | 6/2016 | Berge |
| D761,624 | S | 7/2016 | McLean et al. |
| D771,357 | S | 11/2016 | Brewer |
| D772,014 | S | 11/2016 | Ayres |
| 9,505,527 | B1 | 11/2016 | Campbell |
| D774,837 | S | 12/2016 | Seiders et al. |
| D779,273 | S | 2/2017 | Lee et al. |
| D779,323 | S | 2/2017 | Masrour |
| D779,881 | S | 2/2017 | Lee et al. |
| D780,530 | S | 3/2017 | Seiders et al. |
| D780,531 | S | 3/2017 | Seiders et al. |
| D780,532 | S | 3/2017 | Seiders et al. |
| D780,533 | S | 3/2017 | Seiders et al. |
| D781,662 | S | 3/2017 | Seiders et al. |
| D782,881 | S | 4/2017 | Seiders et al. |
| D783,367 | S | 4/2017 | Seiders et al. |
| D783,368 | S | 4/2017 | Seiders et al. |
| D784,775 | S | 4/2017 | Seiders et al. |
| D785,412 | S | 5/2017 | Petre |
| D786,012 | S | 5/2017 | Hein et al. |
| D786,617 | S | 5/2017 | Breit |
| D787,886 | S | 5/2017 | Cerasani |
| D787,893 | S | 5/2017 | Seiders et al. |
| D787,894 | S | 5/2017 | Seiders et al. |
| 9,637,270 | B2 | 5/2017 | Campbell |
| D788,544 | S | 6/2017 | Seiders et al. |
| D789,796 | S | 6/2017 | McSweeney et al. |
| D790,285 | S | 6/2017 | Seiders et al. |
| D791,550 | S | 7/2017 | Marret |
| D794,397 | S | 8/2017 | Seiders et al. |
| D795,019 | S | 8/2017 | Seiders et al. |
| D795,020 | S | 8/2017 | Seiders et al. |
| D796,261 | S | 9/2017 | Khalifa et al. |
| D799,898 | S | 10/2017 | Yao |
| D799,900 | S | 10/2017 | Santos et al. |
| D799,906 | S | 10/2017 | Seiders et al. |
| D799,907 | S | 10/2017 | Seiders et al. |
| D799,908 | S | 10/2017 | Seiders et al. |
| D800,502 | S | 10/2017 | Weernink |
| D803,064 | S | 11/2017 | Marina et al. |
| D803,632 | S | 11/2017 | Seiders et al. |
| D804,906 | S | 12/2017 | Diener et al. |
| D805,852 | S | 12/2017 | Seiders et al. |
| D806,477 | S | 1/2018 | Wray et al. |
| D807,125 | S | 1/2018 | Seiders et al. |
| D808,220 | S | 1/2018 | Burns et al. |
| D809,344 | S | 2/2018 | Guthrie |
| D809,920 | S | 2/2018 | Maple |
| D811,817 | S | 3/2018 | Harrington, III et al. |
| D811,818 | S | 3/2018 | Wu |
| D813,613 | S | 3/2018 | Wall |
| D814,241 | S | 4/2018 | Nickley et al. |
| D814,865 | S | 4/2018 | Breit |
| D816,411 | S | 5/2018 | Stover |
| D817,713 | S | 5/2018 | Lin |
| D817,714 | S | 5/2018 | Breit |
| D818,775 | S | 5/2018 | Woodruff |
| D819,403 | S | 6/2018 | Li et al. |
| D820,650 | S | 6/2018 | Seiders et al. |
| D821,138 | S | 6/2018 | Silsby et al. |
| D823,068 | S | 7/2018 | Seiders et al. |
| D823,069 | S | 7/2018 | Seiders et al. |
| D824,218 | S | 7/2018 | Seiders et al. |
| 10,040,593 | B2 | 8/2018 | Ross |
| D828,094 | S | 9/2018 | Jackson et al. |
| D828,095 | S | 9/2018 | Jackson et al. |
| D828,751 | S | 9/2018 | Ploeger |
| D829,056 | S | 9/2018 | Wall |
| D829,058 | S | 9/2018 | Seiders et al. |
| D829,101 | S | 9/2018 | Spivey et al. |
| D830,773 | S | 10/2018 | Jacobsen |
| D830,774 | S | 10/2018 | Jacobsen |
| D830,784 | S | 10/2018 | Moore et al. |
| D831,436 | S | 10/2018 | Seiders et al. |
| D834,373 | S | 11/2018 | Spivey et al. |
| 10,118,735 | B2 | 11/2018 | Campbell |
| D836,389 | S | 12/2018 | Abante et al. |
| D837,597 | S | 1/2019 | Silsby |
| 10,251,468 | B1 | 4/2019 | Moore et al. |
| D847,630 | S | 5/2019 | Cotan |
| 10,384,832 | B2 | 8/2019 | Johnson |
| D862,228 | S | 10/2019 | Yao |
| D876,227 | S | 2/2020 | Ramsey |
| D885,892 | S | 6/2020 | Paquet |
| D897,151 | S | 9/2020 | Bullock et al. |
| D902,643 | S | 11/2020 | Park |
| D907,954 | S | 1/2021 | Ludolph |
| D908,487 | S | 1/2021 | Xia |
| D917,225 | S | 4/2021 | Huang |
| D917,960 | S | 5/2021 | Yao |
| D922,829 | S | 6/2021 | Campbell et al. |
| 11,034,505 | B2 | 6/2021 | Bullock |
| D931,042 | S | 9/2021 | Burga et al. |
| D935,268 | S | 11/2021 | Bullock et al. |
| 2004/0045972 | A1 | 3/2004 | Stokes |
| 2004/0124192 | A1 | 7/2004 | Teller |
| 2005/0224442 | A1 | 10/2005 | White |
| 2005/0269322 | A1 | 12/2005 | Betras et al. |
| 2007/0051687 | A1 | 3/2007 | Olson |
| 2007/0119517 | A1 | 5/2007 | Grace |
| 2007/0125785 | A1 | 6/2007 | Robinson et al. |
| 2007/0175906 | A1 | 8/2007 | Caladrino |
| 2007/0221693 | A1 | 9/2007 | Moore |
| 2009/0056369 | A1 | 3/2009 | Fink et al. |
| 2009/0266737 | A1 | 10/2009 | Cole |
| 2010/0005828 | A1 | 1/2010 | Fedell |
| 2010/0084362 | A1 | 4/2010 | Letchinger et al. |
| 2010/0288723 | A1 | 11/2010 | Mayer |
| 2011/0011823 | A1 | 1/2011 | Moore |
| 2011/0114588 | A1 | 5/2011 | Nowzari |
| 2011/0204048 | A1 | 8/2011 | Carino et al. |
| 2012/0145591 | A1 | 6/2012 | Ceder |
| 2012/0199548 | A1* | 8/2012 | Kitto ..... B65D 55/16 215/316 |
| 2013/0153591 | A1 | 6/2013 | Grimes et al. |
| 2013/0206717 | A1 | 8/2013 | Lane |
| 2014/0238949 | A1 | 8/2014 | Patel |
| 2015/0021346 | A1 | 1/2015 | Cappuccio |
| 2015/0232232 | A1 | 8/2015 | Shibuki et al. |
| 2017/0008207 | A1 | 1/2017 | Tamarindo |
| 2018/0162608 | A1 | 6/2018 | Kim |
| 2018/0194518 | A1 | 7/2018 | Li et al. |
| 2018/0194537 | A1 | 7/2018 | Chan |
| 2019/0152655 | A1 | 5/2019 | Lake |

FOREIGN PATENT DOCUMENTS

| | | | |
|---|---|---|---|
| DE | 102004025620 | A1 | 2/2006 |
| EP | 1452455 | A1 | 9/2004 |
| FR | 1054716 | A | 2/1954 |
| JP | 2008030773 | A | 2/2008 |
| KR | 20100000510 | U | 1/2010 |
| TW | M460607 | U | 9/2013 |
| WO | 2008063750 | A2 | 5/2008 |

OTHER PUBLICATIONS

Benefits of Stainless Steel Water Bottles, [online] posted on Mar. 1, 2012, retrieved on Jan. 28, 2019 Retrieved from <URL: https://

(56) References Cited

OTHER PUBLICATIONS b2bbusinessnews.wordpress.com/2012/03/01/benefits-of-stainless-steel-water-bottles/>, 3 pages.

Brewtis the BottleKeeper. [online], posted on Dec. 28, 2013, retrieved on Jan. 28, 2019. Retrieved from, <URL: http://www.dudeiwantthat.com/gear/food-drink/brewtis-the-bottlekeeper.asp>, 22 pages.

EarthLust Stainless Steel Water Bottle, [online], product reviewed on Oct. 17, 2008, retrieved on Jan. 28, 2019, Retrieved from, <URL: https://www.amazon.com/dp/B001DYOCOW?tag=new-best-seller-20>, 4 pages.

Neiko 71010 Stainless Steel Sports Water Bottle, [online], published on Nov. 3, 2009, retrieved on Jan. 28, 2019, Retrieved from, <URL: https://www.amazon.com/Eco-Friendly-Mouth-Stainless-Steel-Bottle/dp/B002VDA2AC/ref=sr_1_107?s=sporting-goods&ie=UTFB&qid=1396116064&s%E2%80%A6>, 8 pages.

Wawabots Personalized Photo Water Bottles, [online], published on Nov. 30, 2011, retrieved on Jan. 28, 2019. Retrieved from, <URL: https//inhabitat.com/inhabitatots/product-review-wawabots-personalized-photo-water-bottles/>, 7 pages.

"Meymom Baby Bottle Thread Changer or Bottle Converter; Allow Spectra S1 S2 Pumps' Wide Mouth Flanges to use Medela Bottles, Ameda Bottles, Lifefactory Bottles, Dr. Brown Narrow Neck Bottles, 4 pc." https://www.amazon.com/Maymom-Changer-Converter-Spectra-Lifefactory/dp/B01EUNA96W?th=1 (published 2016). Retrieved Jan. 21, 2022. (5 pages).

Simple Modern Ascent Handle Lid: Announced Oct. 28, 2017 [online]. Site Visited [Jan. 28, 2022]. Available from Internet URL: https://www.amazon.com/Simple-Modern-Ascent-Handle-Lid/dp/B076FHVZBH.

Stanley Replacement Lid: Announced May 26, 2020 [online]. Site Visited [Feb. 9, 2022]. Available from Internet URL: https://www.amazon.co.uk/Stanley-10-08920-001-Replacement-Plug/dp/B082LZST96.

Universal Vacuum Flask Pot Stopper Cup Cap: Site Visited [Feb. 9, 2022]. Available from Internet URL: http://www.ebay.com/itm/304018532062?chn=ps&var=603173204378&_trkparms=ispr%3D1&amdata=enc%3A1IOBCXa-0QGKFU E-9 KtPxzQ46&norover=1&mkevt=1&mkrid=711-117182-37290-0mkcid=2&itemid=603173204378_304018532062&targetid=1599090336417&device=c&mktype=&googleloc=9059726&poi=& campaignid=15275224983&mkgroupip=131097072938&rl.

* cited by examiner

PROTECTIVE BOTTLE ENCLOSURE

CROSS-REFERENCE TO RELATED APPLICATIONS

This application is a continuation-in-part of U.S. application Ser. No. 16/154,550, filed on Oct. 8, 2018, and entitled "Protective Bottle Enclosure," which is a continuation of U.S. application Ser. No. 15/584,013, filed on May 1, 2017, entitled "Protective Bottle Enclosure," and issued as U.S. Pat. No. 10,118,735 on Nov. 6, 2018, which is a continuation of U.S. application Ser. No. 15/362,540, filed on Nov. 28, 2016, entitled "Protective Bottle Enclosure," and issued as U.S. Pat. No. 9,637,270 on May 2, 2017, which is a continuation of U.S. application Ser. No. 14/153,688, filed on Jan. 13, 2014, entitled "Protective Bottle Enclosure," and issued as U.S. Pat. No. 9,505,527 on Nov. 29, 2016, which claims priority to U.S. Provisional Application Ser. No. 61/752,404, filed on Jan. 14, 2013, and entitled "Protective Bottle Enclosure", all of which are hereby incorporated herein by reference in their entirety and are to be considered a part of this specification.

BACKGROUND

1. Field of the Disclosure

The present disclosure relates generally to food and beverages, and more particularly to containers for holding beverages and beverage bottles.

2. Description of the Background of the Disclosure

Many people like to drink beverages while on the go. Beverages are often carried by people for different reasons and to different places, such as to the beach, to the office, in the car, on a boat, at the golf course, at the shopping mall, and other similar places. Once opened, however, a bottle can spill contents, wasting the beverage and creating a mess. Further, for some beverages, once the bottle is opened, the beverage contained therein will lose its freshness or effervescence as gases in the beverage leave the beverage and escape the bottle. Some bottles have caps or lids designed to be re-applied to an open bottle top so as to close the bottle and prevent spills. However, many bottles, such as glass bottles, do not have caps or lids that can be re-applied. Instead, the beverages in these bottles must generally consumed in one sitting, or the drinker must drink some of the beverage immediately after opening and then the rest at a later time, sacrificing the freshness or effervescence when finishing the beverage. Further, most beverages, if consumed over a period of time, will gradually equalize with the ambient temperature of the environment, which can be undesirable if the beverage was meant to be consumed very hot or very cold. An improved device for carrying a beverage is needed.

SUMMARY

According to one aspect, a protective bottle enclosure including a container comprising an upper portion and a base configured to be removably coupled to the upper portion. The upper portion extends from an annular lip at a first end through a neck, a shoulder, and a body to a bottom section including a bottom opening at a second end opposite the first end. The annular lip defines a top opening to the interior cavity of the upper portion, and the neck includes a plurality of threaded portions and a plurality of planar portions located intermediate the plurality of threaded portions. The enclosure further includes a removable cap including a sidewall from which extends a first threaded portion and a second threaded portion. The first and second threaded portions are located along opposing sides of the sidewall, and a first slot and a second slot are disposed adjacent and between the first and second threaded portions. The first and second slots of the cap are axially aligned with the plurality of threaded portions of the neck when the cap is inserted into the neck of the container.

According to another aspect, a protective bottle enclosure includes a container comprising an upper portion that extends from an annular lip at an upper end through a neck, a shoulder, and a body to a bottom section including a bottom opening at a lower end. The neck includes at least one threaded portion and at least one planar portion. The enclosure further includes a base configured to be removably coupled to the upper portion, the base having a bottom surface and a sidewall extending from the bottom surface, the base being removably coupled with the second end of the body, and a removable cap including a sidewall from which extends a first cap threaded portion and a first cap planar portion disposed adjacent the first cap threaded portion. The cap can be axially inserted into the neck until a stopper engages with a mouth of a bottle that is disposed within the container, and the cap is in a fully sealed configuration upon rotation of the cap by less than 180 degrees once the stopper has engaged with the mouth.

According to still another aspect, a cap for a protective bottle enclosure, includes a knob that is formed with a tab that can be gripped and rotated, a collar depending from the knob opposite the tab and being defined by a sidewall, a first threaded portion that extends outwardly from the sidewall, a second threaded portion that extends outwardly from the sidewall, a first planar portion of the sidewall disposed between the first threaded portion and the second threaded portion, and a second planar portion of the sidewall disposed between the first threaded portion and the second threaded portion.

DETAILED DESCRIPTION

Figure 1:
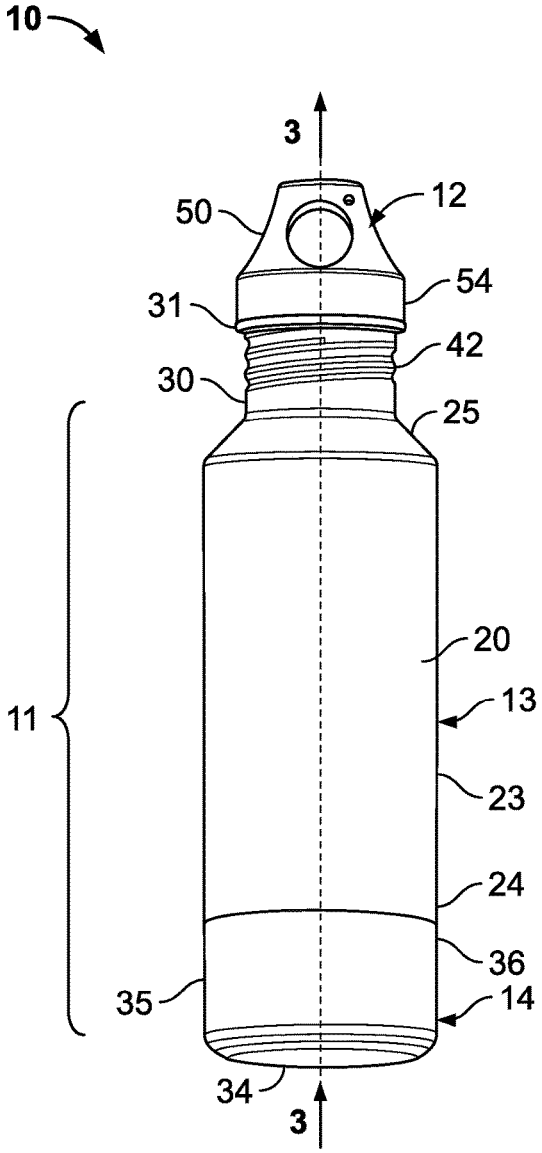
FIG. 1 is a front perspective view of a protective bottle enclosure constructed and arranged in accordance with the principle of the disclosure, including a container having an upper portion, a base applied to the upper portion, and a cap applied to the upper portion.
Figure 2:
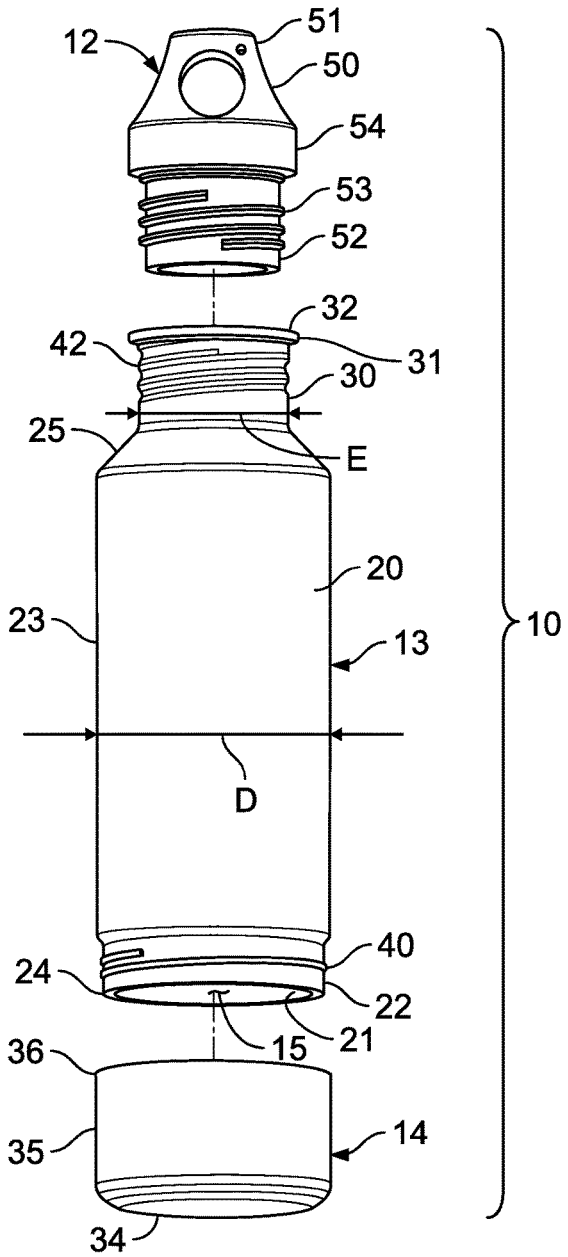
FIG. 2 is an exploded front perspective view of the protective bottle enclosure of FIG. 1.

Reference is now made to the drawings. FIG. 1 illustrates a protective bottle enclosure 10 constructed and arranged according to the principle of the disclosure. FIG. 2 illustrates the same enclosure 10 in an exploded view. The enclosure 10 is useful for containing, concealing, and insulating a bottle applied to the enclosure in such a way that a beverage from the bottle can be consumed while the bottle is protected within the enclosure 10. The enclosure 10 includes a container 11 and a cap 12 removably applied to the container 11. The container 11 is preferably constructed from a material or materials having material characteristics of strength and rigidity, such as metal or plastic. The container 11 is preferably a two-piece unit having a main upper portion 13 and a base 14 removably applied to the upper portion 13. The upper portion 13 and base 14 cooperate to define a generally cylindrical interior 15 (indicated in FIG. 2) which receives the beverage bottle that the enclosure 10 protects. The upper portion 13 and base 14 are preferably extruded or rolled from thin-walled aluminum or the like.

The upper portion 13 is formed from a continuous thin sidewall 20 having opposed inner and outer surfaces 21 and 22 which are parallel to each other and set just slightly apart, defining a very thin thickness of the sidewall 20. The upper portion 13 of the container 11 defines a majority of the container 11 and has a body 23 extending from a bottom 24 to a shoulder 25 of the container 11. The shoulder 25 is an annular narrowing of the container 11 which tapers from the body 23 to a neck 30 of the container 11. The neck 30 extends upward to a finish 31 which terminates in an annular lip 32. The body 23 of the upper portion has a constant diameter D from just above the bottom 24 to the just below the shoulder 25. The neck has a diameter E which is less than the diameter D of the body 23, since the shoulder 25 between the body 23 and the neck 30 tapers in diameter between the two. The lip 32 flares outward slightly from the diameter E of the neck 30.

The base 14 is removable from the upper portion 13 so that a bottle may be introduced into the interior 15 and carried therein. Still referring to FIGS. 1 and 2, the base 14 has a flat bottom 34 and an upstanding, annular sidewall 35 extending upward from the bottom 34 and terminating in an open top 36. To releasably couple the base 14 to the upper portion 13, a fastening assembly is carried between the upper portion 13 and the base 14. At the bottom 24 of the body 23, the upper portion 13 of the container 11 has a reduced diameter and is formed with external threads 40. Complemental internal threads are carried on the sidewall 35 of the base 14. Though not visible in FIGS. 1 and 2, the internal threads are visible in FIG. 3 and are identified there with the reference number 41. The two sets of threads 40 and 41 threadably engage the base 14 to the upper portion 13 of the container 11 and allow the base 14 to be quickly and easily removed from the upper portion 13. By aligning the threads 40 and 41 and rotating the base 14 with respect to the upper portion 13 in a clockwise direction, the base 14 is secured to the upper portion 13. Conversely, by rotating the base 14 in a counter-clockwise direction with respect to the upper portion 13 and retracting the base 14 away from the upper portion 13, the base 14 is removed from the upper portion 13, and the bottom 24 of the upper portion 13 is open, defining an entrance available to apply a bottle there through into the interior 15 of the container 11. One having ordinary skill in the art will readily appreciate that the relative direction of the threads 40 and 41 may be reversed so that the direction of rotation of the base 14 with respect to the upper portion 13 would be correspondingly reversed to apply and remove the base 14 from the upper portion 13. One having ordinary skill in the art will also appreciate that another suitable fastening mechanism may be used to removably engage the base 14 to the upper portion 13.

Figure 3:
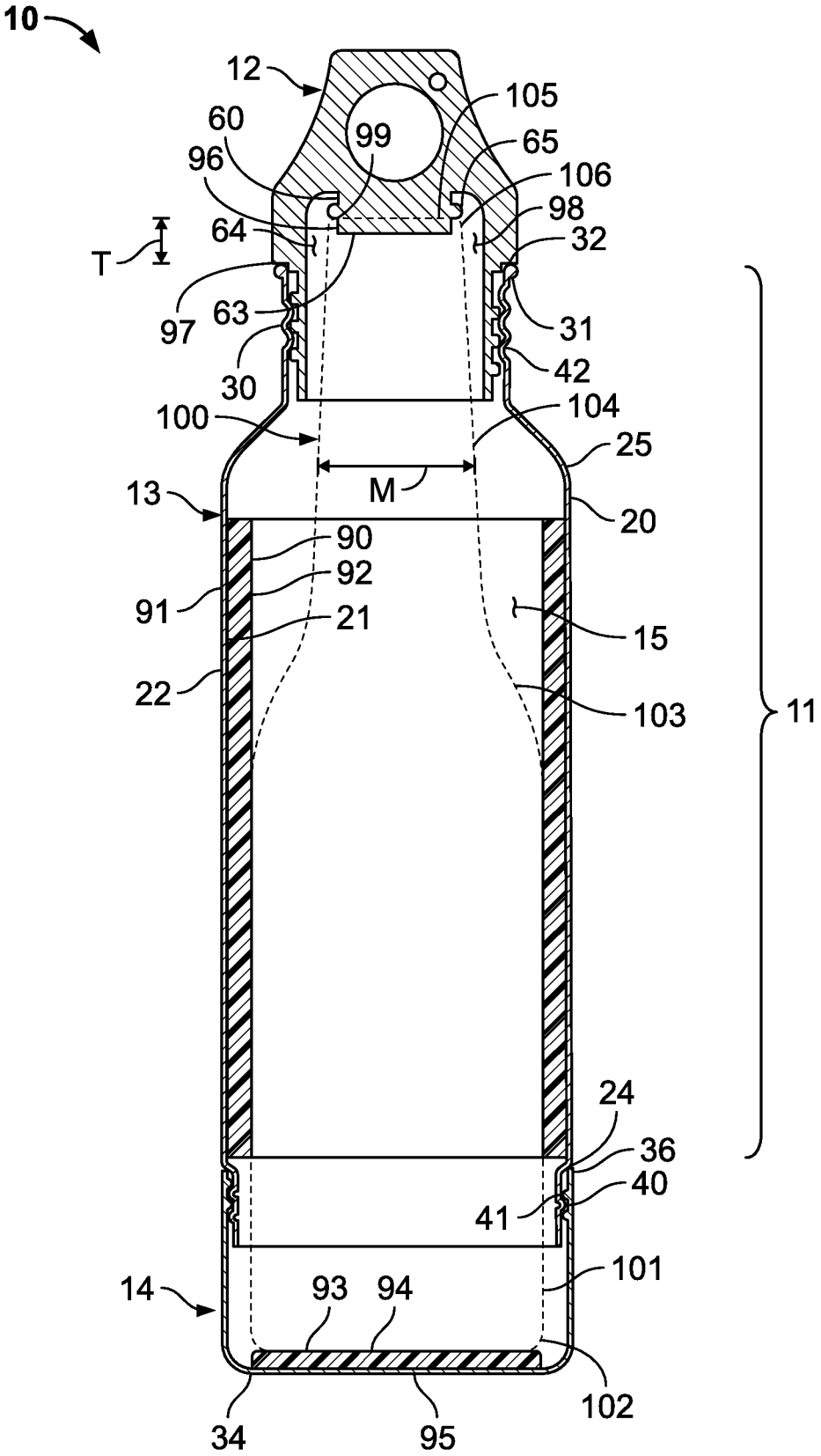
FIG. 3 is a section view of the protective bottle enclosure of FIG. 1 taken along the line 3-3 in FIG. 1.

Turning briefly to FIG. 3, a bottle 100 has been applied to the interior 15 of the container 11. The bottle 100 is shown in ghost form, or in broken line, in FIG. 3, which is a section view taken along the line 3-3 in FIG. 1. The container 11 has rotational symmetry about a vertical axis extending through the interior 15 along a geometric center of the container 11. The bottle 100 is applied to the enclosure 10, and has a body 101, a bottom 102, a shoulder 103, and a long neck 104 terminating in an open mouth 105 at a top 106 of the bottle 100. The mouth 105 of the bottle 100 has an internal diameter M. The bottle 100 has been, and is preferably, inserted into the enclosure 10 with the mouth 105 open so that the cap 12 seals the mouth 105 when the cap 12 is fully applied and seated to the container 11.

Figure 4A:
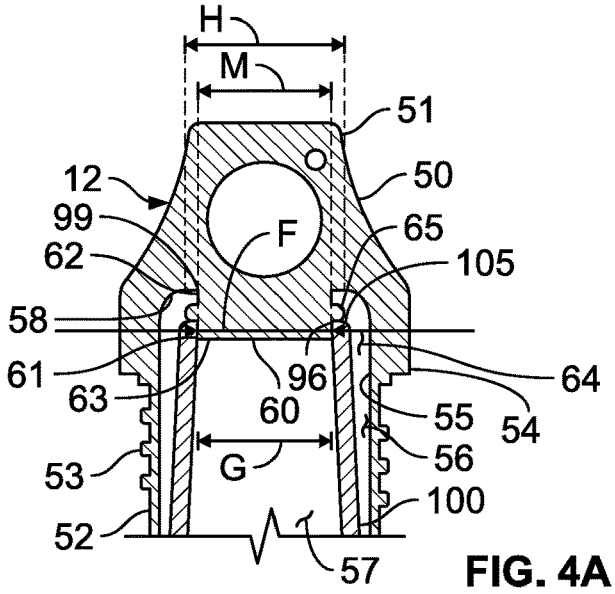
FIGS. 4A-4C are section views of three embodiments of caps taken along similar lines as FIG. 3.
Figure 4B:
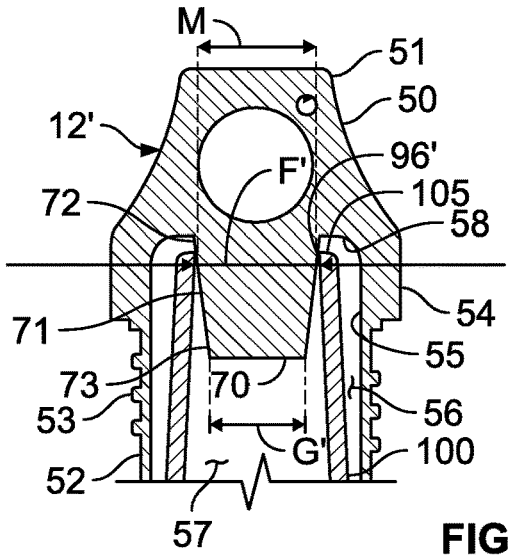
Figure 4C:
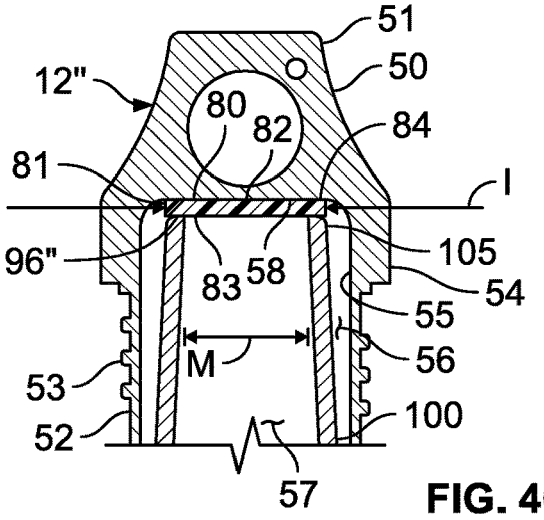

Referring now back to FIG. 2 primarily, the cap 12 is removably applied to the container 11 to seal the container 11. The neck 30 of the upper portion 13 of the container 11 carries threads 42 which are formed integrally in the neck 30 and extend both inwardly and outwardly. The threads 42 allow the cap 12 to be threadably engaged to the container 11 to secure and release the cap 12 on the container. Three cap embodiments are shown in FIGS. 4A-4C and are identified as the caps 12, 12', and 12", respectively. Discussion of the cap 12 in FIG. 4A will be made first, and then, turning to FIGS. 4B and 4C, the discussion will be of the caps 12' and 12" and the various structural elements and features which are different from the cap 12. Discussion of structural elements and features which are identical in the caps 12, 12', and 12" will not be repeated in the description of the caps 12' and 12".

FIG. 4A illustrates an enlarged section view of the cap 12 taken along the line 3-3 in FIG. 1. The cap 12 consists of a knob 50 formed with a tab or extension 51 providing a contact surface to be gripped and rotated, and a collar 52 depending from the knob 50 opposite the extension 51. The collar 52 is a thin cylindrical sleeve which extends downward from the knob 50 and carries external threads 53. The threads 53 extend radially outward from the collar 52. The threads 53 of the cap 12 threadably engage with the internal threads 42 formed in the neck 30 of the upper portion 13, so that the cap 12 is applied and engaged to the upper portion 13 by aligning the threads 53 and 42 and rotating the cap 12 clockwise relative to the upper portion 13, and the cap 12 is retracted and disengaged from the upper portion 13 by rotating the cap 12 counterclockwise relative to the upper portion 13. One having ordinary skill in the art will understand that the relative direction of the threads 42 and 53 may be reversed and that the direction of rotation of the cap 12 relative to the upper portion 13 would be correspondingly reversed to apply and remove the cap 12. The cap has a cuff 54 disposed between the extension 51 and the collar 52 extending radially outward from an underside 58 of the extension 51 and defining a lower portion of the extension 51. The cuff 54 is a cylindrical sidewall having an inner surface 55 cooperating with the collar 52 to bound an internal, generally cylindrical volume 56 with an opening 57 located opposite the extension 51.

Still referring to FIG. 4A, the cap 12A has a sealing structure to seal the mouth 105 of the bottle 100 while housed in the container 11. The cap 12 has a stopper 60 with a body 61 which is an inverted truncated conical frustum that tapers in diameter away from the cap 12. The body 61 has a top 62 and an opposed bottom 63 with a diameter G, and the diameter G at the bottom 63 is smaller than the diameter at the top 62 of the body 61. The top 62 of the body 61 is applied to the underside 58 of the knob 50. The body 61 is constructed from a material or combination of materials having material characteristics of resiliency, elasticity, and shape memory, such as rubber, so that the body 61 of the stopper 60 can be compressed radially under pressure and return to its original shape when the compression is removed. The body 61 of the stopper 60 extends within the cylindrical volume 56 as far as the cuff 54, and an annular volume 64 in communication with the cylindrical volume 56 is defined between the body 61 of the stopper 60 and the inner surface 55 of the cuff 54 which encircles the stopper 60 within the cap 12.

An annular flange 65 is formed on the body 61 of the stopper 60. The flange 65 is a ring formed monolithically and integrally to the body 61, and the flange extends continuously around the body 61 parallel to the top 62 and bottom of the stopper 60. The body 61 has a diameter F just under the flange 65, and the flange 65 has a diameter H, which is larger than the diameter F and the diameter G of the bottom 63 of the body 61 of the stopper 60. The diameter H of the flange 65 is greater than the diameter M of the mouth 105 of the bottle 100, and the diameter M of the mouth 105 is larger than the diameter G of the bottom 63 of the stopper 60 but just smaller than the diameter F of the stopper 60. The flange 65 is constructed from a material having rigid material characteristics, such as plastic. The flange 65 is formed on the body 61 at a generally intermediate location with respect to the top 62 and bottom 63.

Turning now to FIG. 4B, the cap 12' is shown. As explained above, the cap 12' shares various structural elements and features in common with the cap 12, and as such, those structural elements and features will not be described here. Those structural elements and features are identified in the discussion of the cap 12' with the same reference characters as above, and the discussion below is directed toward the differences of cap 12'. The cap 12' has a knob 50, extension 51, collar 52, threads 53, cuff 54, inner surface 55, cylindrical volume 56, opening 57, and underside 58, but the cap 12' presents an alternate stopper 70.

The stopper 70 has a body 71 which is an inverted truncated conical frustum that tapers in diameter away from the cap 12'. The body 71 has a top 72 and an opposed bottom 73 with respective diameters F' and G', and the diameter G' at the bottom 73 is smaller than the diameter F' at the top 72 of the body 71. The top 72 of the body 71 is applied to the underside 58 of the knob 50. The body 71 is constructed from a material or combination of materials having material characteristics of resiliency, elasticity, and shape memory, such as rubber, so that the body 71 of the stopper 70 can constrict and be compressed radially under pressure and return to its original shape when the compression is removed. The body 71 of the stopper 70 extends within the cylindrical volume 56 as far as the cuff 54, and the annular volume 64 in communication with the cylindrical volume 56 is defined between the body 71 of the stopper 70 and the inner surface 55 of the cuff 54 which encircles the stopper 70 within the cap 12. The diameter M of the mouth 105 of the bottle 100 is larger than the diameter G' of the bottom 73 of the stopper 70 but is smaller than the diameter F' of the top 62 of the bottle 100. In this way, when the cap 12' is applied to and seated on the container 11, the mouth 105 encircles and constricts the stopper 60 between the top 62 and bottom 63.

Turning now to FIG. 4C, the cap 12" is shown. Again, as explained above, the cap 12" shares various structural elements and features in common with the cap 12, and as such, those structural elements and features will not be described here. Those structural elements and features are identified in the discussion of the cap 12" with the same reference characters as above, and the discussion below is directed toward the differences of cap 12". The cap 12" has a knob 50, extension 51, collar 52, threads 53, cuff 54, inner surface 55, cylindrical volume 56, opening 57, and underside 58, but the cap 12' presents an alternate stopper 80.

The stopper 80 of the cap 12" is a pad 81 carried on the underside 58 of the knob 50. The pad 81 includes an upper surface 82, an opposed lower surface 83, and a compressible middle layer 84 between the upper and lower surfaces 82 and 83. The upper surface 82 is permanently applied, such as with an adhesive, to the underside 58 of the knob 50 and extends across the underside 58 encircled by the inner surface 55 of the cuff 54. The pad 81 has a diameter I, which is greater than the diameter M of the mouth 105 of the bottle 100. The pad 81 is constructed from a material or combination of materials having compressible, elastic, resilient, and durable material characteristics, such as elastomeric rubber and the like.

The caps 12, 12', and 12" each seal the open bottle 100 and the container 11 when used as part of the enclosure 10. The bottle 100 is held within the enclosure 10 by the cap and by elastomeric padding or forms within the container 11. The elastomeric forms are applied to the upper portion 13 and the base 14 to provide insulation to the bottle 100, to provide impact protection to the bottle 100, and to hold the bottle 100 securely, both while the bottle 100 is enclosed by the enclosure 10 and while the bottle is tipped and being drunk from. With reference back to FIG. 3, the upper portion 13 has an upper form 90 with an outer surface 91 applied, such as with an adhesive, to the inner surface 21 of the container 11 and an inner surface 92 extending into the interior 15 of the enclosure 10. The upper form 90 has a generally cylindrical shape extending from the bottom 24 of the upper portion 13 to the shoulder 25. The upper form 90 is constructed from a material or combination of materials having material characteristics of compressibility, durability, resiliency, and shape memory, and which is a good insulator. The base 14 has a base pad 93 with an upper surface 94 and an opposed lower surface 95 applied, such as with an adhesive, to the bottom 34 of the base 14. The base form 93 is disc shaped and extends along the bottom 34 of the base 14. The sidewall of the base 14 is uncovered in the interior 15. Like the upper form 90, the base form 93 is constructed from a material or combination of materials having the material characteristics of compressibility, durability, resiliency, and shape memory, and which is a good insulator. The upper and base forms 90 and 93 securely position and hold the bottle 100 in place within the container and provide insulation to keep the beverage in the bottle 100 hot or cold.

In operation, the enclosure 10 is useful for protecting, insulating, and concealing the bottle 100 within the enclosure 10. To apply the bottle 100 to the enclosure 10, the base 14 is decoupled from the upper portion 13 by rotating the base 14 relative to the upper portion 13 while retracting the base 14 and then withdrawing the base 14 from the upper portion 13, exposing the open bottom 24 of the upper portion 13 and the interior 15 ready to receive the bottle 100. The bottle 100 is held, such as by hand, and inserted into the interior 15 with the mouth 105 of the bottle 100 introduced first into the interior 15. The bottle 100 is applied to and inserted into the interior 15 until the mouth 105 of the bottle 100 is disposed just below the lip 32 on the finish 31 of the upper portion 13. As the bottle 100 is applied into the interior 15, the bottle 100 radially compresses the upper form 90 against the sidewall 20 of the upper portion 13. As shown in FIG. 3, above the shoulder 103 of the bottle 100, the upper form 90 is uncompressed and has a normal thickness, while along the body 101 of the bottle 100, the upper form 90 is compressed and has a reduced thickness. The bottle 100 is thus held in a friction fit arrangement by the upper form 90 which limits vertical movement in and out of the upper portion 13.

Once the bottle 100 is placed into the upper portion 13, the base 14 is coupled to the upper portion 13. The base 14 is aligned with the upper portion 13 and moved toward and over the bottom 24 of the upper portion 13 while rotating the base 14 with respect to the upper portion 13 so as to threadably engage the base 14 onto the upper portion 13. The base 14 is rotated completely until the base 14 is firmly seated on the upper portion 13 and the top 36 of the base 14 is against the bottom 24 of the upper portion 13, sealing the base 14 on the upper portion 13 and forming the container 11. If, before coupling the base 14 to the upper portion 13, the bottle 100 had not been fully applied to the upper portion 13, then when the base 14 is seated to the upper portion 13, the base 14 will advance the bottle 100 further into the upper portion 13 to a preferred location in the interior 15. If the bottle 100 had been applied too far into the interior 15, then application of the cap 12 to the upper portion 13 will re-position the bottle 100 in the opposite direction. Any of the caps 12, 12', and 12" may be applied and seated on the upper portion 13. Seating any of the caps 12, 12', and 12" on the container 12 forms seals between the bottle 100 and the cap 12 and between the container 11 and the cap 12. Application of each will now be discussed.

FIG. 3 and FIG. 4A show the cap 12 fully seated on the upper portion 13 in a seated position of the cap 12, sealing the open mouth 105 of the bottle 100. To apply the cap 12 to the container 11 with the bottle 100 held in the container 11, the cap 12 is free of the container 11 and is aligned with the neck 30 and finish 31 of the container 11 in a free condition of the cap 12. The threads 53 on the cap 12 are directed downwardly toward the threads 42 on the neck 30 of the container 11. The cap 12 is then rotated onto the neck 30, threadably engaging the threads 53 on the cap 12 with the threads 42 formed in the neck 30 of the container 11 to move the cap 12 into an applied condition on the container 11. As the cap 12 is threaded onto the container 11, the cap 12 is applied to the container 11, and the bottom 63 of the stopper 60 moves into the mouth 105 of the bottle 100. The bottom 63 of the stopper 60 has a diameter G which is less than the diameter M of the mouth 105, so that the mouth 105 begins to receive the stopper 60. As the cap 12 is further threaded onto the container 11, the stopper 60 advances further into bottle 100, filling a greater portion of the diameter M of the mouth 105.

In this applied condition of the cap 12, the cap 12 forms a fluid-permeable seal with the container 11. As the cap 12 is still further threaded onto the container 11, however, the stopper 60 fills the entire mouth 105 of the bottle 100, and begins to be compressed and constricted radially by the mouth 105. The cap 12 continues to be advanced until the top 106 of the bottle 100 encounters the flange 65 on the stopper 60, at which point the cuff 54 of the cap 12 fully seats against the lip 32 of the upper portion 13 of the container 11. The diameter F of the body 61 of the stopper 60 just below the flange 65 is just greater than the diameter M of the mouth 105, and the diameter H of the flange 65 is greater than the diameter M of the mouth 105, so that the mouth 105 is received against an inward shoulder 99 formed by the body 61 of the stopper 60 and the flange 65, defining a seated condition of the cap 12. In this seated condition, the stopper 60 forms a fluid-impervious seal 96 with the mouth 105 of the bottle 100, so that the beverage in the bottle 100 cannot leave the bottle 100 and enter the interior 15. Further, the cuff 54 of the cap 12 fully seated against the lip 32 of the container and forms a fluid-impervious seal 97 with the container 11. This seal 97 prevents any moisture in the interior 15 from exiting the interior 15 and also prevents any fluids outside of the enclosure 10 from entering the interior 15. The seal 96 is considered an inner seal, and the seal 97 is considered an outer seal spaced apart from the inner seal, so that the enclosure 10 has a unique double-seal construction which is formed when the cap 12 is in the seated condition on the container 11.

Alternately, the bottle 100 and container 11 can be sealed by the cap 12'. FIG. 4B shows the cap 12' fully seated on and sealing the open mouth 105 of the bottle 100. FIG. 4B does not show the container 11, as one having ordinary skill in the art will understand how the cap 12' seats on the container 11, given the above description of the cap 12 and the container 11, and given the below description. To apply the cap 12' to the container 11 with the bottle 100 held in the container 11, the cap 12' is free of the container 11 and is aligned with the neck 30 and finish 31 of the container 11 in a free condition of the cap 12'. The threads 53 on the cap 12' are directed downwardly toward the threads 42 on the neck 30 of the container 11. The cap 12' is then rotated onto the neck 30, threadably engaging the threads 53 on the cap 12' with the threads 42 formed in the neck 30 of the container 11 to move the cap 12' into an applied condition on the container 11. As the cap 12' is threaded onto the container 11, the cap 12' is applied to the container 11, and the bottom 73 of the stopper 70 moves into the mouth 105 of the bottle 100.

The bottom 73 of the stopper 70 has a diameter G' which is less than the diameter M of the mouth 105, so that the mouth 105 begins to receive the stopper 70. As the cap 12' is further threaded onto the container 11, the stopper 70 advances further into bottle 100, filling a greater portion of the diameter M of the mouth 105. In this applied condition of the cap 12', the cap 12' only yet forms a fluid-permeable seal with the container 11. As the cap 12' is still further threaded onto the container 11, however, the stopper 70 fills the entire mouth 105 of the bottle 100, and begins to be compressed and constricted radially by the mouth 105. The cap 12' continues to be advanced until the top 106 of the bottle 100 binds on the body 71 of the stopper 70, at which point the cuff 54 of the cap 12' also fully seats against the lip 32 of the upper portion 13 of the container 11. The diameter of the body 71 of the stopper 70 encircled by the mouth 105 is just less than the diameter M of the mouth 105, defining a seated condition of the cap 12 on the container 11. In this seated condition, the stopper 70 forms a fluid-impervious seal 95' with the mouth 105 of the bottle 100, so that the beverage in the bottle 100 cannot leave the bottle 100 and enter the interior 15. This seal 96 is considered an inner seal. Further, the cuff 54 of the cap 12' fully seated against the lip 32 of the container and forms a fluid-impervious seal with the container 11. This seal is considered an outer seal, and it prevents any moisture in the interior 15 from exiting the interior 15 and also prevents any fluids outside of the enclosure 10 from entering the interior 15. The enclosure 10 has this unique double-seal construction which is formed when the cap 12' is in the seated condition on the container 11.

Alternately, the bottle 100 and container 11 can be sealed by the cap 12". FIG. 4C shows the cap 12" fully seated on and sealing the open mouth 105 of the bottle 100. FIG. 4C does not show the container 11, as one having ordinary skill in the art will understand how the cap 12" seats on the container 11, given the above description of the cap 12 and the container 11, and given the below description. To apply the cap 12' to the container 11 with the bottle 100 held in the container 11, the cap 12' is free of the container 11 and is aligned with the neck 30 and finish 31 of the container 11 in a free condition of the cap 12". The threads 53 on the cap 12" are directed downwardly toward the threads 42 on the neck 30 of the container 11. The cap 12" is then rotated onto the neck 30, threadably engaging the threads 53 on the cap 12" with the threads 42 formed in the neck 30 of the container 11 to move the cap 12" into an applied condition on the container 11. As the cap 12" is threaded onto the container 11, the cap 12" is applied to the container 11, the mouth 105 of the bottle 100 contacts the lower surface 83 of the pad 81 of the stopper 80.

As the cap 12" is still further threaded onto the container 11, the mouth 105 of the bottle 100 advances into the pad 81, deflecting the lower surface 83 and compressing the middle layer 84 toward the upper surface 82. The pad 81 continues to be compressed by the mouth 105 until the cap 12" is fully threaded onto the container 11, seating the cuff 54 of the cap 12" against the lip 32 of the container 11 in a seated condition of the cap 12". In the seated condition of the cap 12", a fluid-impervious seal 96" is formed between the pad 81 and the mouth 105 of the bottle 100, which seal 96" is considered an inner seal preventing the loss of the beverage contained in the bottle 100 into the interior 15 of the enclosure 10. Further, in the seated condition of the cap 12", the cuff 54 of the cap 12" forms a fluid-impervious seal with the container 11. This seal is considered an outer seal, and it prevents any moisture in the interior 15 from exiting the interior 15 and also prevents any fluids outside of the enclosure 10 from entering the interior 15. The enclosure 10 has this unique double-seal construction which is formed when the cap 12" is in the seated condition on the container 11.

Once the enclosure 10 is sealed with the cap 12, 12', or 12" (discussion herein with respect to the cap 12), the bottle 100 can be carried, tilted, or tipped without spilling the beverage within the bottle 100 inside the enclosure 10. The cap 12 can be removed to allow a person to drink from the bottle 100, simply by unthreading the cap 12 from the container 11 and moving the cap 12 into the free condition thereof, exposing the mouth 105 of the bottle 100 which is spaced above the lip 32 of the upper portion 13 of the container 11 by a distance T. The mouth 105 is also spaced apart from the lip 32 of the upper portion 13 of the container 11 by an annular gap 98 encircling the mouth 105. This annular volume 64 is a gap between the mouth 105 of the bottle 100 and the lip 32 of the enclosure 10 which allows a person to place his or her lips on the bottle itself. This can prevent spilling of the beverage into the interior 15 or simply out of the bottle 100 altogether, because a seal is formed between the mouth 105 of the bottle 100 and the person's lips. Alternatively, the person may place his or her lips around the lip 32 of the enclosure 10 and drink from the bottle 100.

Figure 5A:
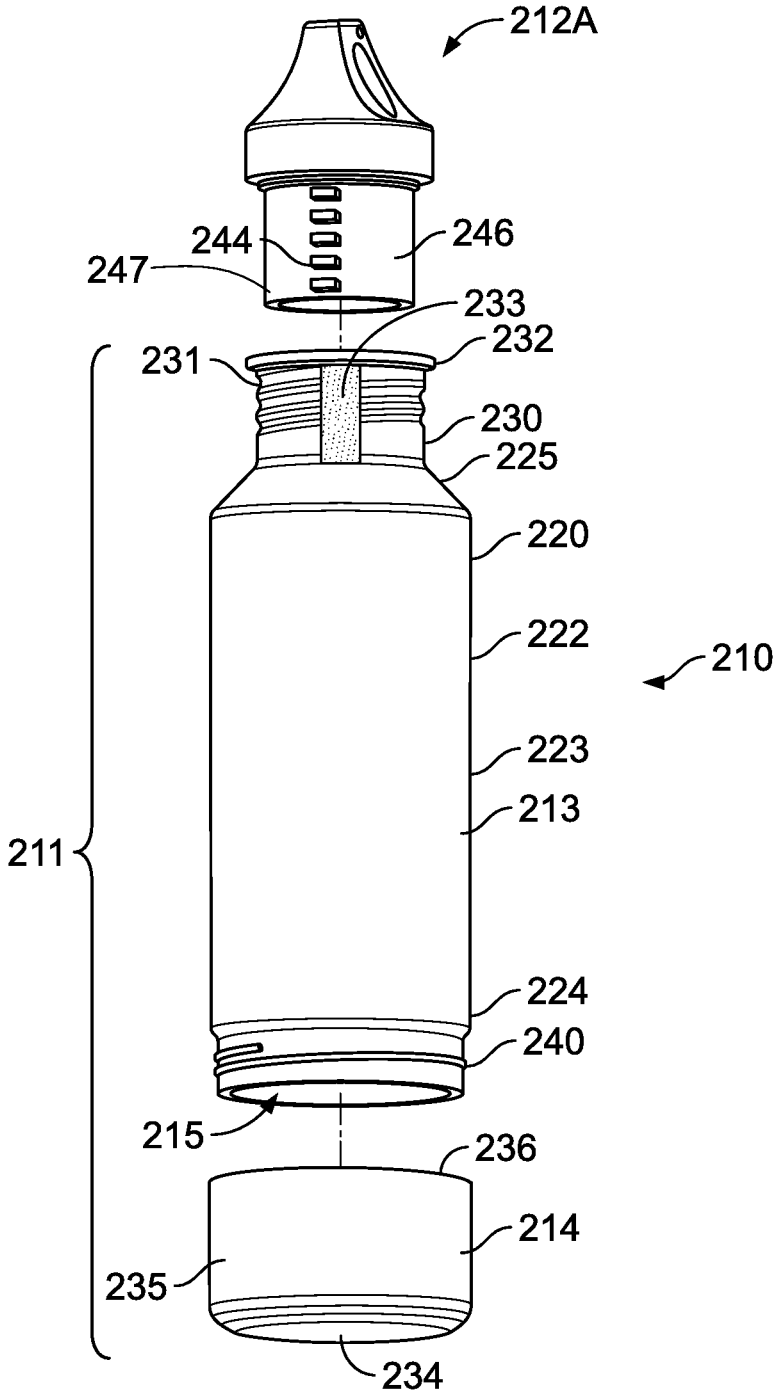
FIG. 5A is an exploded front perspective view of another protective bottle enclosure having a modified cap and neck in accordance with the present disclosure.
Figure 5B:
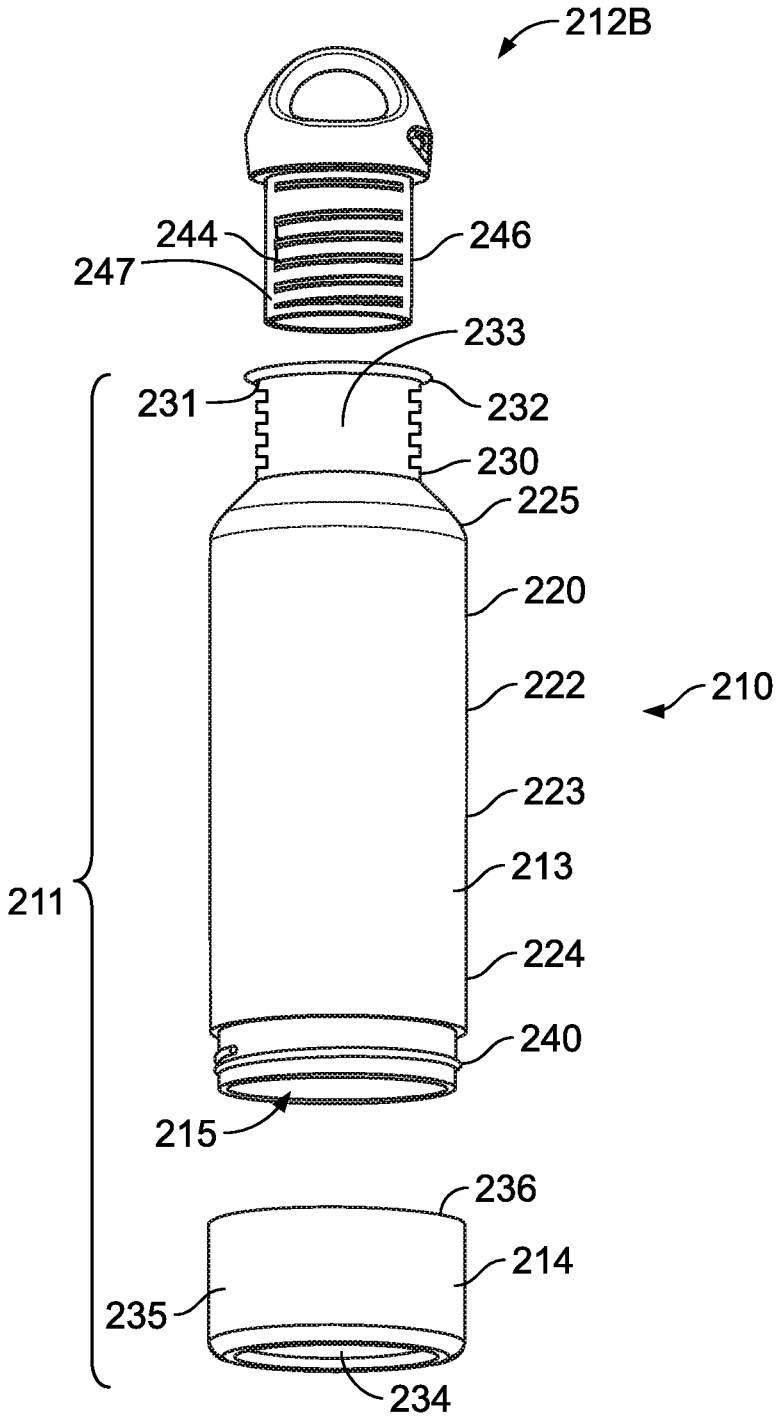
FIG. 5B is an exploded front perspective view of yet another protective bottle enclosure having a modified cap and neck.

Referring now to an alternative embodiment depicted in FIGS. 5A-19, a protective bottle enclosure 210 including a container 211 and a cap 212A, 212B is shown. Referring to FIGS. 5A and 5B, alternative caps 212A, 212B are depicted. The caps 212A, 212B include similar functional characteristics, and differ with respect to the orientation, cross section, and length of threading that is included along the caps 212A, 212B. As will be discussed hereinafter below, the cap 212A includes relatively less threading therealong than the cap 212B of FIG. 5B. The cap 212A also includes threading that is aligned in a uniform structure while the cap 212B includes threads having varying dimensions. Still further, the cap 212A includes threading having a rectangular cross section, while the cap 212B includes threading having a trapezoidal cross-section. The amount of threading included along the caps 212A, 212B may be a function of a desired seal, manufacturing considerations, or material considerations. However, the caps 212A, 212B generally operate in the same fashion, and allow a user to quickly seal the protective bottle enclosure 210 with a single rotation of the caps 212A, 212B, or less than a single rotation.

Figure 5C:
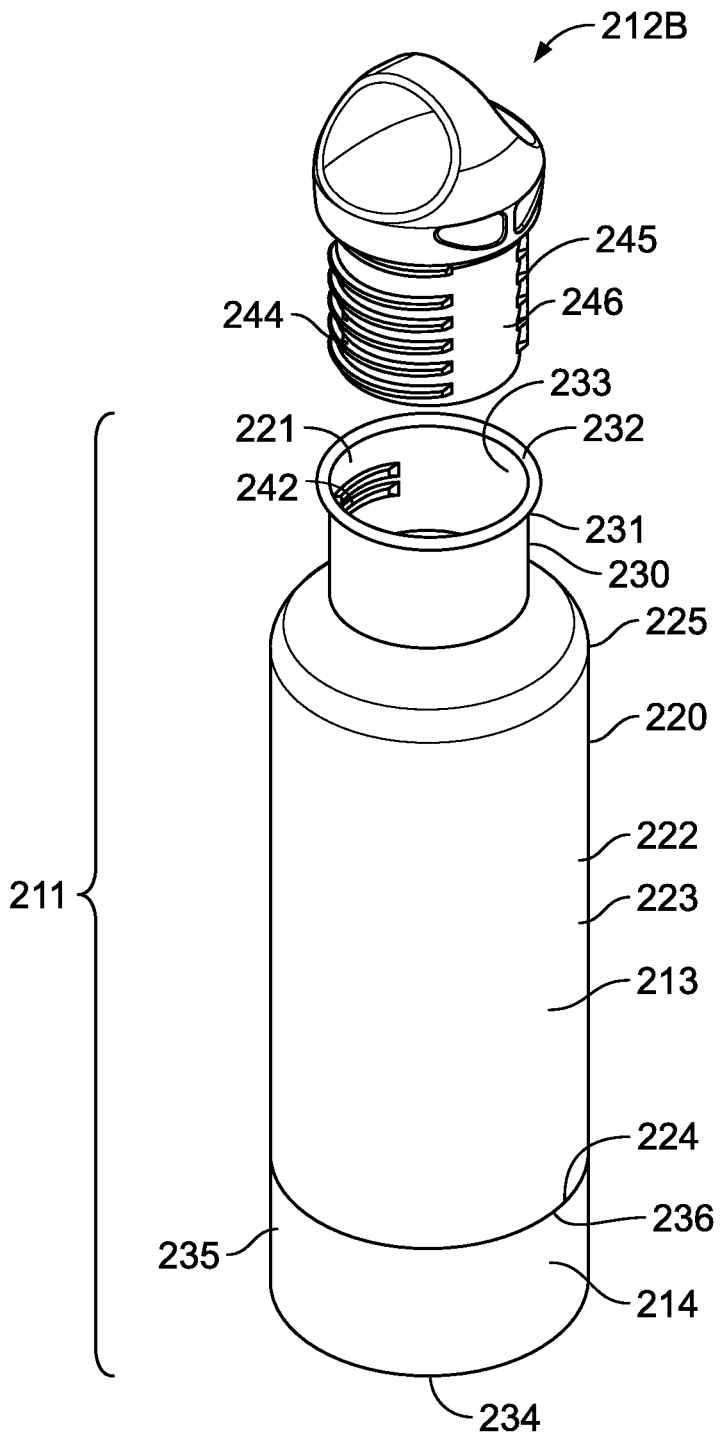
FIG. 5C is an exploded front perspective view of still another protective bottle enclosure having a modified cap and neck.
Figure 6:
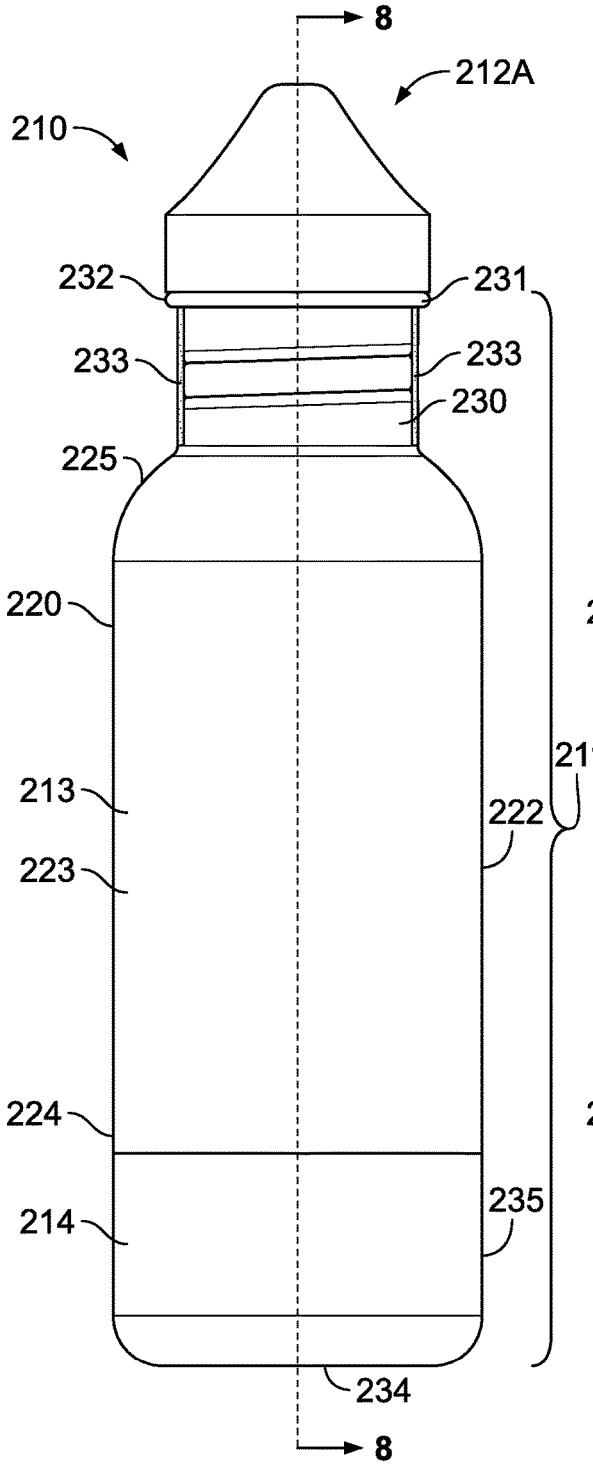
FIG. 6 is a front elevational view of the bottle enclosure of FIG. 5A in a closed state.
Figure 7:
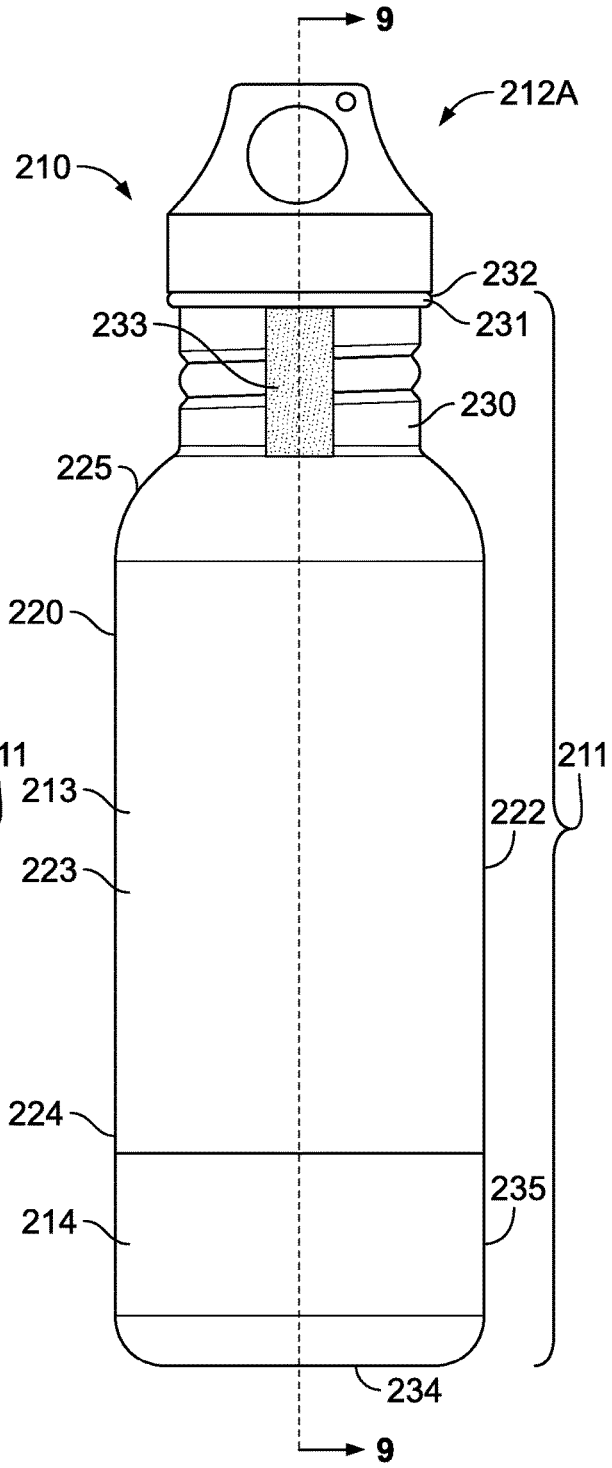
FIG. 7 is a side elevational view of the bottle enclosure of FIG. 5A in the closed state.

Specifically referring to FIGS. 5A-5C, 6, and 7, the container 211 and the cap 212A, 212B may be combined, or may exist separately. As a result, the enclosure 210 includes distinct components, i.e., the container 211 and the cap 212, which combine to form the enclosure 210. As discussed with respect to the enclosure 10, the enclosure 210 is useful for containing, concealing, and insulating a bottle applied to the enclosure 210 in such a way that a beverage from the bottle can be consumed while the bottle is protected within the enclosure 210. The enclosure 210 includes the container 211 and the cap 212A, 212B, which is removably applied to the container 211. Referring to FIGS. 5B and 5C, alternative configurations of the container 211 are depicted. FIG. 5B illustrates the container 211 having neck threading that is visible along an outer side of the neck, while FIG. 5C illustrates the container 211 having neck threading that is only visible along an inner side of the neck. As discussed below, alternative configurations of the neck threading are contemplated and certain aspects of the embodiments of FIGS. 5A-5C may be combined with one another to form alternative variations of the enclosure 210 not specifically addressed herein.

Still referring to FIGS. 5A-5C, 6, and 7, the container 211 is preferably constructed from a material or materials having material characteristics of strength and rigidity, such as metal or plastic. In some embodiments, the container 211 is a unitary component that does not include a removable portion. The container 211 can be a two-piece unit having a main upper portion 213 and a base 214 removably applied to the upper portion 213. The upper portion 213 and base 214 cooperate to define a generally cylindrical interior 215 which receives the beverage bottle that the enclosure 210 protects. The upper portion 213 and base 214 can be extruded or rolled from thin-walled aluminum or the like. The upper portion 213 and base 214 combine to form an interior 215 of the container 211.

Figure 8:
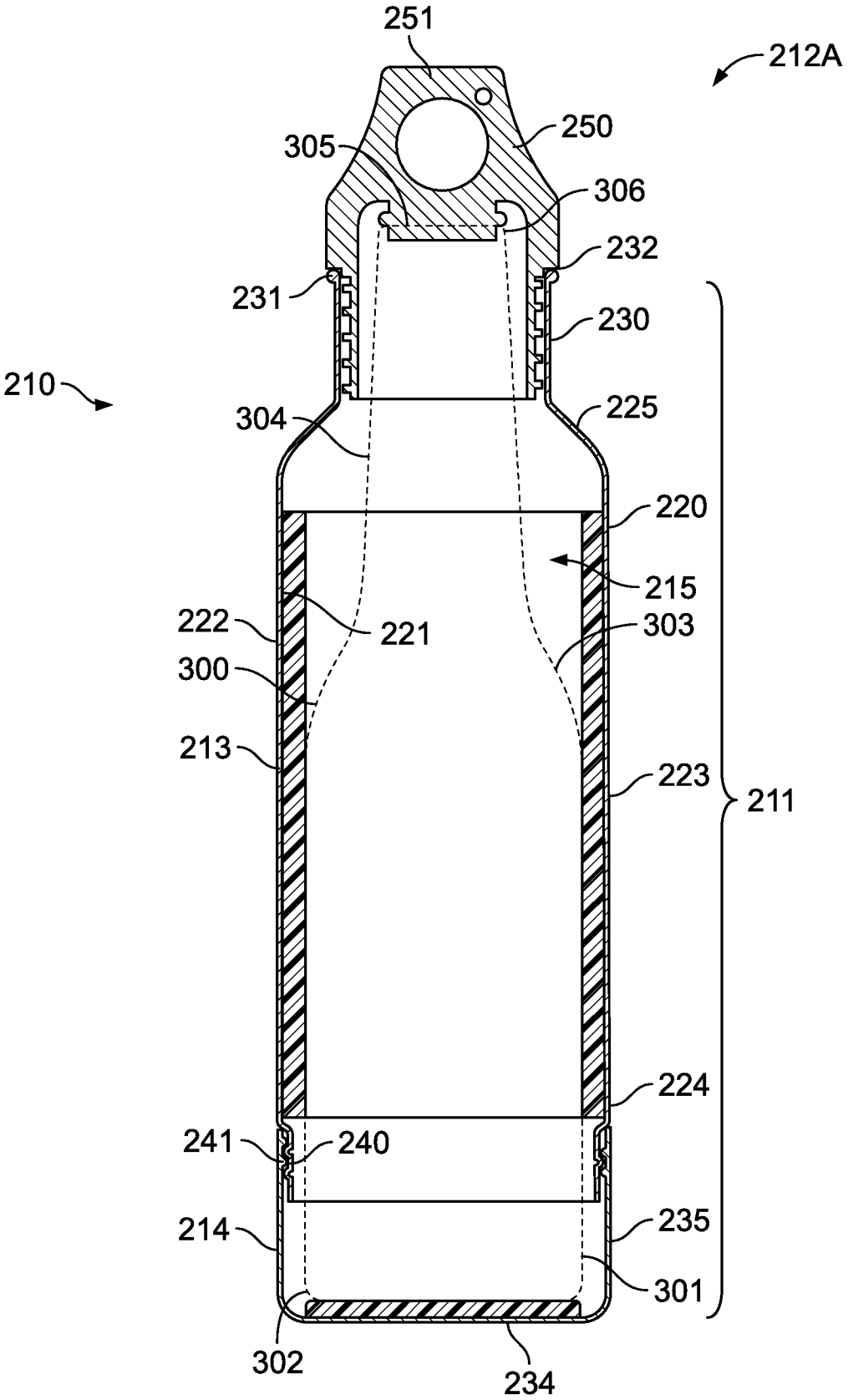
FIG. 8 is a section view of the protective bottle enclosure taken through line 8-8 of FIG. 6.

Referring to FIG. 8, the upper portion 213 is formed from a continuous thin sidewall 220 having opposed inner and outer surfaces 221 and 222 which are parallel to each other and set just slightly apart, defining a thickness of the sidewall 220. The upper portion 213 of the container 211 defines a majority of the container 211 and has a body 223 extending from a bottom 224 to a shoulder 225 of the container 211. The shoulder 225 is an annular narrowing of the container 211 which tapers from the body 223 to a neck 230 of the container 211. The neck 230 extends upward to a finish 231 which terminates in an annular lip 232. The body 223 of the upper portion has a constant diameter from just above the bottom 224 to the just below the shoulder 225. The neck 230 has a diameter which is less than the diameter of the body 223, since the shoulder 225 between the body 223 and the neck 230 tapers in diameter between the two. The lip 232 flares outward slightly from the diameter of the neck 230.

Referring again to FIGS. 5A-5C, slots or planar portions 233 are disposed along opposing sides of the neck 230, which allow the cap 212 to be easily inserted into the neck 230 of the container 211. As further illustrated in the figures, the base 214 is removable from the upper portion 213 so that a bottle may be introduced into the interior 215 and carried therein. The base 214 has a flat bottom 234 and an upstanding, annular sidewall 235 extending upward from the bottom 234 and terminating in an open top 236. To releasably couple the base 214 to the upper portion 213, a fastening assembly is carried between the upper portion 213 and the base 214. At the bottom 224 of the body 223, the upper portion 213 of the container 211 has a reduced diameter and is formed with external threads 240. Complemental internal threads 241 are carried on the sidewall 235 of the base 214 (see FIG. 8). The two sets of threads 240 and 241 (see FIG. 8) threadably engage the base 214 to the upper portion 213 of the container 211 and allow the base 214 to be quickly and easily removed from the upper portion 213. By aligning the threads 240 and 241 and rotating the base 214 with respect to the upper portion 213 in a clockwise direction, the base 214 is secured to the upper portion 213.

Conversely, by rotating the base 214 in a counter-clockwise direction with respect to the upper portion 213 and retracting the base 214 away from the upper portion 213, the base 214 is removed from the upper portion 213, and the bottom 224 of the upper portion 213 is open, defining an entrance available to apply a bottle therethrough into the interior 215 of the container 211. One having ordinary skill in the art will readily appreciate that the relative direction of the threads 240 and 241 may be reversed so that the direction of rotation of the base 214 with respect to the upper portion 213 would be correspondingly reversed to apply and remove the base 214 from the upper portion 213. One having ordinary skill in the art will also appreciate that another suitable fastening mechanism may be used to removably engage the base 214 to the upper portion 213.

Figure 9:
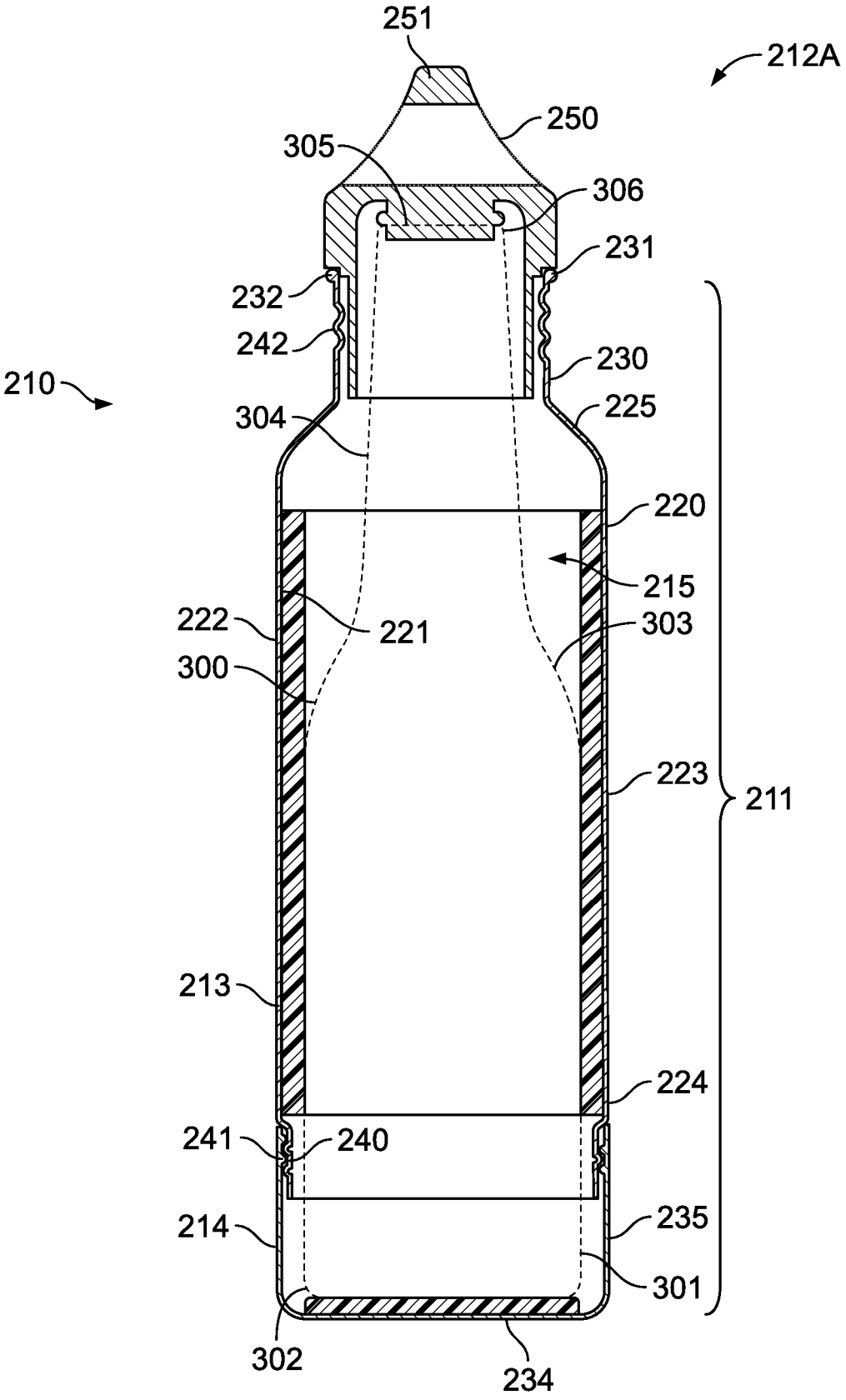
FIG. 9 is a section view of the protective bottle enclosure taken through line 9-9 of FIG. 7.
Figure 10A:
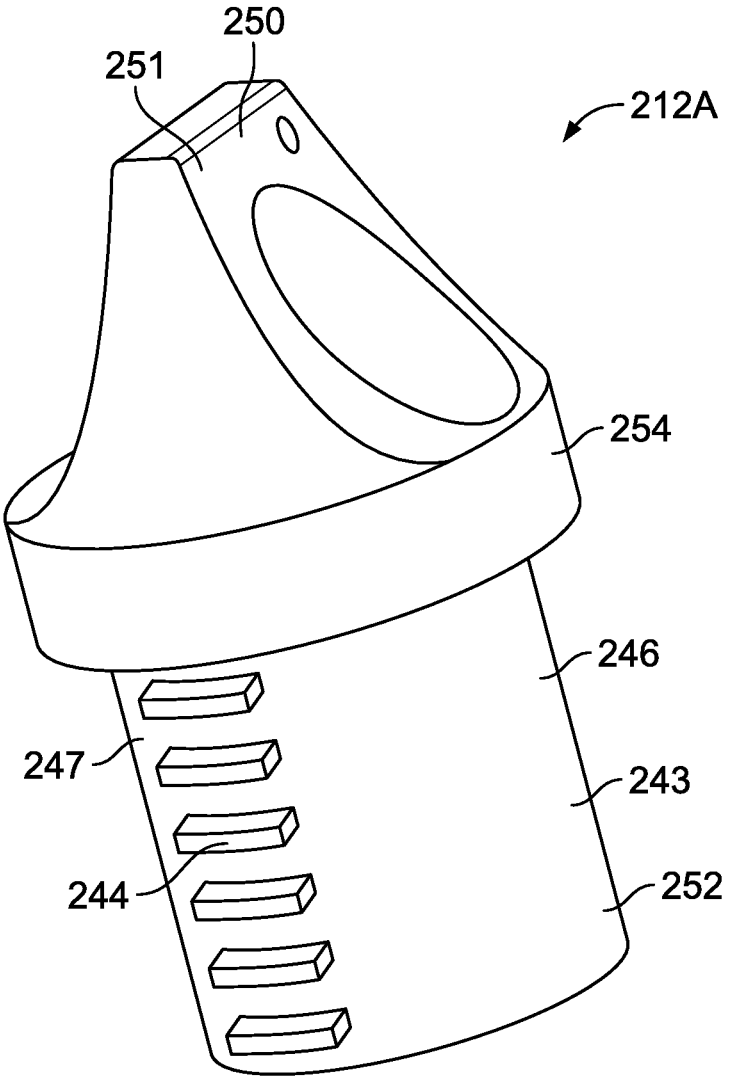
FIG. 10A is a perspective view of the modified cap of the protective bottle enclosure of FIG. 5A.
Figure 10B:
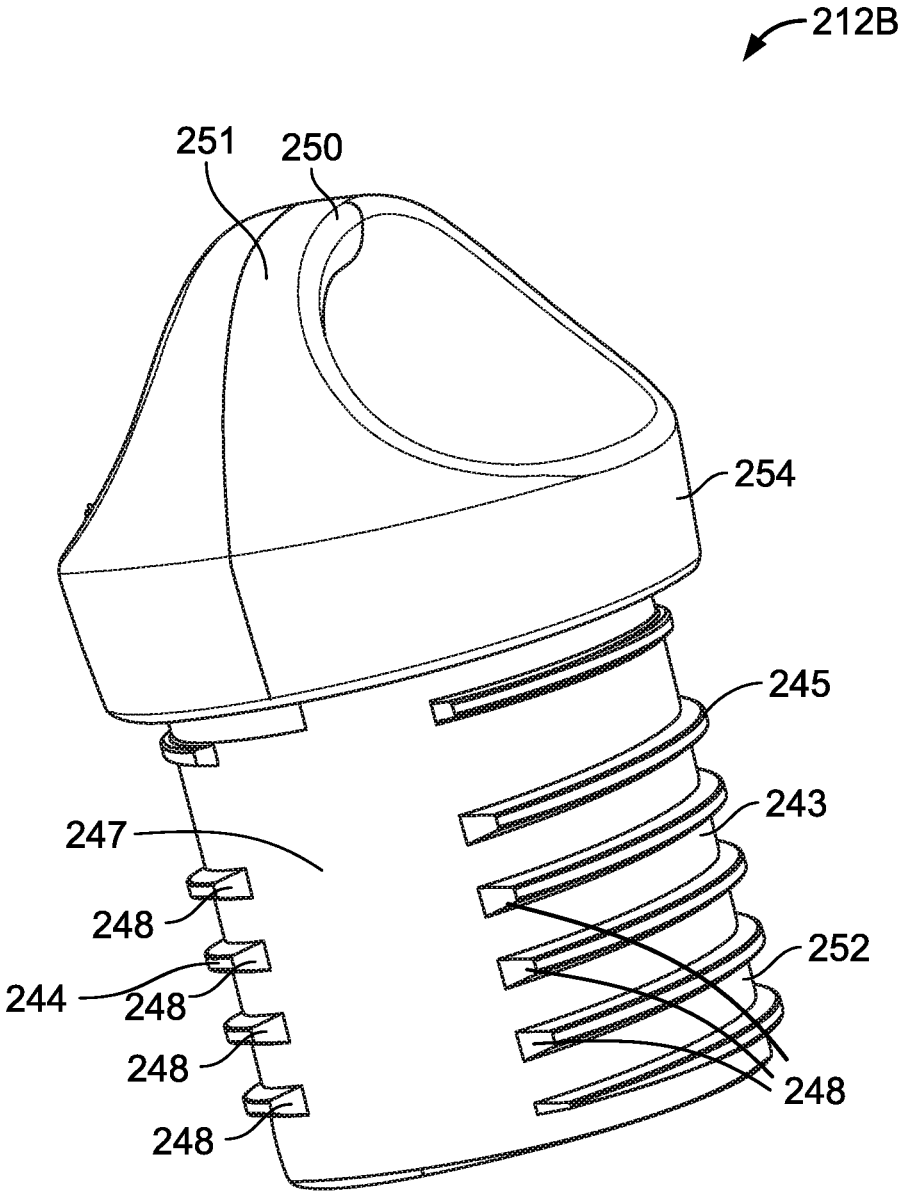
FIG. 10B is a perspective view of the modified cap of the protective bottle enclosure of FIG. 5B.
Figure 11A:
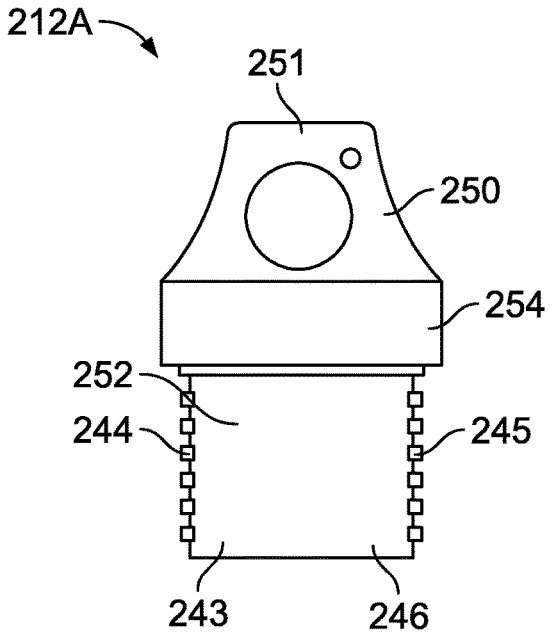
FIG. 11A is a front elevational view of the cap of FIG. 10A.
Figure 12A:
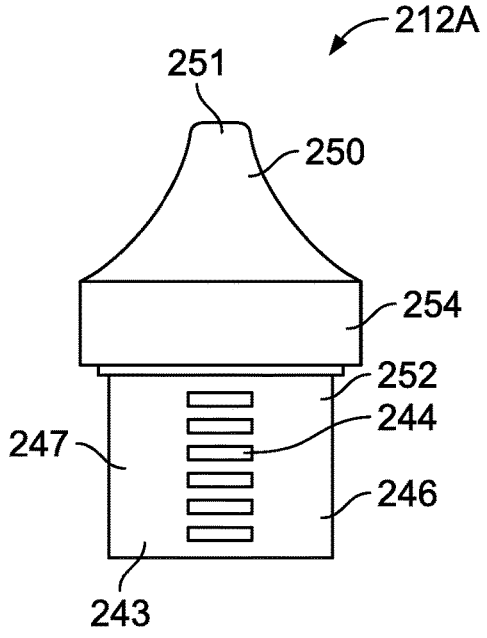
FIG. 12A is a side elevational view of the cap of FIG. 10A.
Figure 13A:
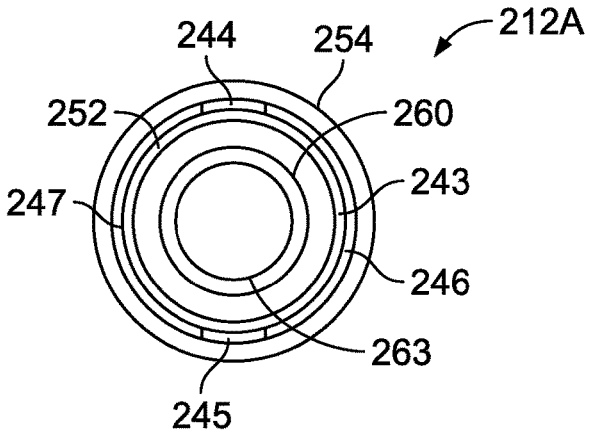
FIG. 13A is a bottom plan view of the cap of FIG. 10A.
Figure 11B:
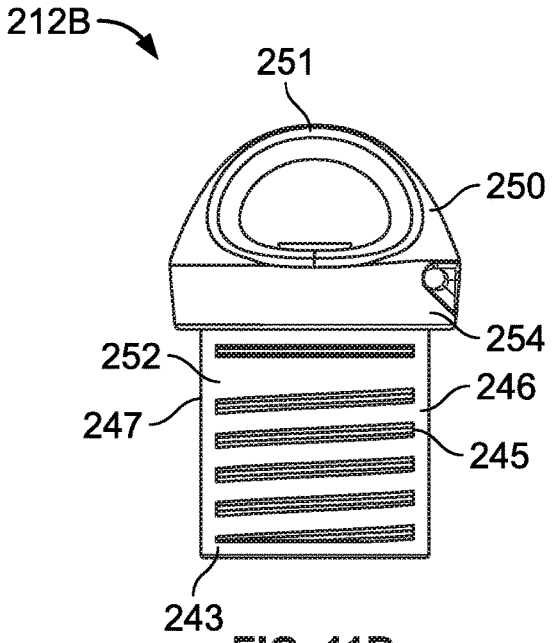
FIG. 11B is a front elevational view of the cap of FIG. 10B.
Figure 12B:
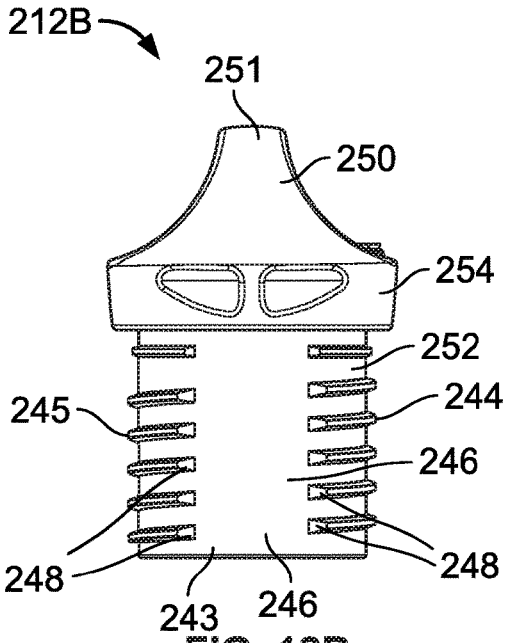
FIG. 12B is a side elevational view of the cap of FIG. 10B.
Figure 13B:
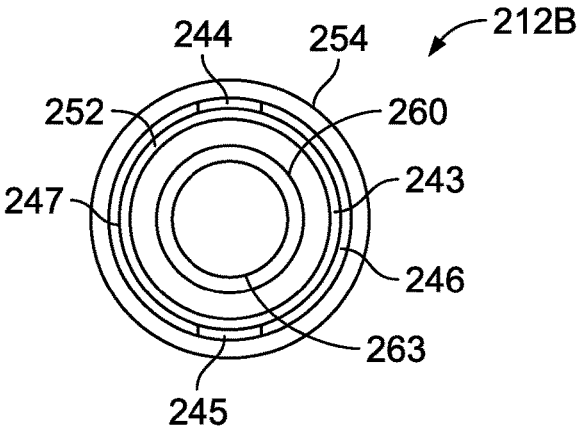
FIG. 13B is a bottom plan view of the cap of FIG. 10B.

Turning briefly to FIGS. 8 and 9, a bottle 300 has been applied to the interior 215 of the container 211. The bottle 300 is shown in ghost form, or in broken line, in FIGS. 8 and 9, which are section views taken along the lines 8-8 and 9-9 of FIGS. 6 and 7, respectively. The container 211 has rotational symmetry about a vertical axis extending through the interior 215 along a geometric center of the container 211. The bottle 300 is applied to the enclosure 210, and has a body 301, a bottom 302, a shoulder 303, and a long neck 304 terminating at a top 306 of the bottle 300 in an open mouth 306. The mouth 305 of the bottle 300 has an internal diameter. The bottle 300 has been, and is preferably, inserted into the enclosure 210 with the mouth 305 open so that the cap 212 seals the mouth 305 when the cap 212 is fully applied and seated to the container 211. The neck 230 further includes internal threads 242, which are interrupted along opposing sides by the planar portions 233.

Referring to FIGS. 10A, 11A, 12A, and 13A, the cap 212A is shown in greater detail. The cap 212A defines a cylindrical sidewall 243. A first or front threaded portion 244 extends outwardly from the sidewall 243 and a second or rear threaded portion 245 also extends outwardly from the sidewall 243. The first and second threaded portions 244, 245 are preferably unitary with the sidewall 243. The first and second threaded portions 244, 245 are also disposed along opposing sides of the cap 212A. As noted above, the first and second threaded portions 244, 245 have generally rectangular cross-sections. The cap 212A further includes a first planar or uninterrupted portion 246 and a second planar or uninterrupted portion 247, which are also disposed along opposing sides of the cap 212A. In some configurations, the first and second planar portions 246, 247 may be more accurately described as first and second slots 246, 247, as discussed below with respect to the cap 212B. The first and second threaded portions 244, 245 may be identical, as disclosed in the figures, or the first and second threaded portions 244, 245 may have threading that is offset from one another. The first and second planar portions 246, 247 may be entirely uninterrupted or may have portions that extend outwardly from the sidewall 243. As will be discussed hereinafter below, the first and second threaded portions 244, 245 and the uninterrupted portions 246, 247 combine to allow for quick connection of the cap 212A with the container 211 since the threaded portions 244, 245 align with the slots or planar portions 233 of the neck 230.

Referring now to FIGS. 10B, 11B, 12B, and 13B, the cap 212B is shown in greater detail. The cap 212B also defines the cylindrical sidewall 243. The first or front threaded portion 244 extends outwardly from the sidewall 243 and the second or rear threaded portion 245 also extends outwardly from the sidewall 243. The first and second threaded portions 244, 245 are preferably unitary with the sidewall 243, in a similar fashion as described above with respect to the cap 212A. The first and second threaded portions 244, 245 are also disposed along opposing sides of the cap 212B. The first and second threaded portions 244, 245 of the cap 212B extend along more of a perimeter of the sidewall 243 than the threaded portions 244, 245 of the cap 212A, and are disposed in a parallel configuration and slightly angled downward. Each of the particular threads of the threaded portions 244, 245 includes a beveled lead-in 248, which may aid in alignment of the cap 212B with the container 211. In the present embodiment, the beveled lead-in is trapezoidal shaped, which generally aligns with a cross-section taken through one of the threads of the threaded portions 244, 245. The sidewall 243 defines an outer perimeter, and in some embodiments, the threaded portions 244, 245 separately extend along 10% of the outer perimeter of the sidewall 243, or along 20% of the outer perimeter of the sidewall 243, or along 30% of the outer perimeter of the sidewall 243, or along 40% of the outer perimeter of the sidewall 243, or 45% of the outer perimeter of the sidewall 243.

Still referring to FIGS. 10B, 11B, 12B, and 13B, the cap 212B further includes the first planar or uninterrupted portion 246 and the second planar or uninterrupted portion 247, which are also disposed along opposing sides of the cap 212B. The first and second planar portions 246, 247 of the cap 212B may be referred to as first and second slots 246, 247 due to the geometry of the first and second threaded portions 244, 245 in the present embodiment. The first and second threaded portions 244, 245 may be identical, mirror images of one another, or may have threading that is offset from one another. In the embodiment of 212B, the first and second threaded portions 244, 245 are asymmetrical, and define a single start spiral thread that is interrupted by the first and second planar portions 246, 247. As a result, if the threaded portions 244, 245 were to be connected with one another, a single thread would define a spiral shape along the sidewall 243 of the cap 212B. As discussed above with respect to the cap 212A, the first and second planar portions 246, 247 of the cap 212B may be entirely uninterrupted or may have portions that extend outwardly or inwardly from the sidewall 243. As will be discussed hereinafter below, the first and second threaded portions 244, 245 and the uninterrupted portions 246, 247 combine to allow for quick connection of the cap 212B with the container 211 since the threaded portions 244, 245 align with the slots 233 of the neck 230.

Referring to FIGS. 10A-13B, the caps 212A, 212B each include a knob 250 formed with a tab or extension 251 providing a contact surface to be gripped and rotated, and a collar 252 depending from the knob 250 opposite the extension 251. For ease of description, only a single cap 212 will be referenced hereinafter, which refers to both the cap 212A and the cap 212B. The collar 252 is generally defined by the sidewall 243 discussed above. The collar 252 is a cylindrical sleeve, which extends downward from the knob 250 and carries the first and second threaded portions 244, 245 and the uninterrupted portions 246, 247. The threaded portions 244, 245 extend radially outward from the collar 252 along front and rear sides of the cap 212. The threaded portions 244, 245 of the cap 212 threadably engage with the internal threads 242 formed in the neck 230 of the upper portion 213, so that the cap 212 is applied and engaged to the upper portion 213 by aligning the threaded portions 244, 245 and the planar portions 233, inserting the cap 212 into the neck 230, and rotating the cap 212 clockwise relative to the upper portion 213. The cap 212 is retracted and disengaged from the upper portion 213 by rotating the cap 212 counterclockwise relative to the upper portion 213 until the threaded portions 244, 245 are aligned with the planar portions 233 and the cap 212 is retracted from the neck 230. The cap 212 has a cuff 254 disposed between the extension 251 and the collar 252. The cuff 254 is a cylindrical sidewall portion that extends outward farther than the collar 252 to provide a stop against the neck 230 when the cap 212 is fully engaged therewith.

Still referring to FIGS. 10A-13B, the caps 212A, 212B may have any of the sealing structures as described above with respect to the caps 12-12." To apply the cap 212 to the container 211 with the bottle 300 held in the container 211, the cap 212 is free of the container 211 and is aligned with the neck 230 and finish 231 of the container 211 in a free condition of the cap 212. The threaded portions 244, 245 on the cap 212 are directed downwardly toward the planar portions 233 on the neck 230 of the container 211. The collar 252 of the cap 212 is then axially inserted into the neck 230 such that the threaded portions 244, 245 are inserted adjacent or along the planar portions 233 that are disposed along or formed along the neck 230. Because of the absence of threading along the planar portions 246, 247 of the cap 212, the internal threading 242 along the neck 230 does not prevent the collar 252 from axial insertion into the neck 230 of the container 211.

Rather, the threaded portions 244, 245 form a lock and key structure with the slots 233 that are disposed along opposing sides of the neck 230, which allows the cap 212 to be inserted into the neck 230 until a sealing structure comprising a stopper 260 (see FIGS. 13A and 13B) that is disposed along an underside of the cap 212 becomes engaged with or physically contacts the top 306 of the bottle 300. In some embodiments, there is no sealing structure along the underside of the caps 212A, 212B. Once the cap 212 has been fully inserted into the container 211, a bottom 263 of the stopper 260 moves into the mouth 305 of the bottle 300. As discussed above with respect to the cap 12, the bottom 263 of the stopper 260 has a diameter that is less than a diameter of the mouth 305, so that the mouth 305 begins to receive the stopper 260. Once the cap 212 has been fully seated onto the mouth 305 of the bottle 300, the cap 212 may be rotated between 10 degrees and 170 degrees in a clockwise direction to fully secure the cap 212 with the container 211.

The cap 212, in a similar fashion as the caps 12, 12', and 12" described above, seals the open bottle 300 and the container 211 when used as part of the enclosure 210. The bottle 300 is held within the enclosure 210 by the cap 212 and by elastomeric padding or forms within the container 211. In some embodiments, the elastomeric padding need not be included. The elastomeric forms are applied to the upper portion 213 and the base 214 to provide insulation to the bottle 300, to provide impact protection to the bottle 300, and to hold the bottle 300 securely, both while the bottle 300 is enclosed by the enclosure 210 and while the bottle 300 is tipped and being drunk from.

Referring now to FIGS. 14-19, views are shown that depict the cap 212A being removably applied to the container 211 to seal the container 211. While FIGS. 14-19 depict the cap 212A being inserted into the container, one of ordinary skill will appreciate that the cap 212A could be replaced with the cap 212B, which requires an alternative threading configuration along the cap 212 and the container 211. However, for ease of disclosure, only the cap 212A is shown and discussed with respect to FIGS. 14-19.

As noted above, the neck 230 of the upper portion 213 of the container 211 carries the internal threads 242, which are formed integrally in the neck 230 and extend both inwardly and outwardly. The threads 242 allow the cap 212A to be threadably engaged to the container 211 to secure and release the cap 212 on the container. However, the planar portions 233 that interrupt the threads 242 allow the threaded portions 244, 245 to be inserted, without axial interruption, into the neck 230 of the container 211. As illustrated with respect to the cap 212B, the planar portions 233 may be uninterrupted slots along the cap that are devoid of threading, and may individually extend along 10% of an inner perimeter of the neck 230, or around 20% of the inner perimeter of the neck 230, or around 30% of the inner perimeter of the neck 230, or around 40% of the inner perimeter of the neck 230, or around 45% of the inner perimeter of the neck 230.

Before application of the cap 212A to the container, the bottle 300 is inserted into the container 211 as described below. As noted above with respect to the enclosure 10, the enclosure 210 is useful for protecting, insulating, and concealing the bottle 300 within the enclosure 210. To apply the bottle 300 to the enclosure 210, the base 214 is decoupled from the upper portion 213 by rotating the base 214 relative to the upper portion 213 while retracting the base 214 and then withdrawing the base 214 from the upper portion 213, exposing the open bottom 224 of the upper portion 213. The bottle 300 is held, such as by hand, and inserted into the interior 215 with the mouth 305 of the bottle 300 introduced first into the interior 215. The bottle 300 is applied to and inserted into the interior 215 until the mouth 305 of the bottle 300 is disposed just below the lip 232 on the finish 231 of the upper portion 213. As the bottle 300 is inserted into the interior 215, the bottle 300 radially compresses the upper form 290 against the sidewall 220 of the upper portion 213. The bottle 300 is thus held in a friction fit arrangement by the upper form 290, which limits vertical movement in and out of the upper portion 213.

Once the bottle 300 is placed into the upper portion 213, the base 214 is coupled to the upper portion 213. The base 214 is aligned with the upper portion 213 and moved toward and over the bottom 224 of the upper portion 213 while rotating the base 214 with respect to the upper portion 213 so as to threadably engage the base 214 onto the upper portion 213. The base 214 is rotated completely until the base 214 is firmly seated on the upper portion 213 and the top 236 of the base 214 is against the bottom 224 of the upper portion 213, sealing the base 214 on the upper portion 213 and forming the container 211.

If, before coupling the base 214 to the upper portion 213, the bottle 300 had not been fully applied to the upper portion 213, then when the base 214 is seated to the upper portion 213, the base 214 will advance the bottle 300 further into the upper portion 213 to a preferred location in the interior 215. If the bottle 300 had been applied too far into the interior 215, then application of the cap 212A to the upper portion 213 will re-position the bottle 300 in the opposite direction. As discussed below, the cap 212A is modified with respect to the cap 12 described above, such that a user can insert the cap 212A axially into the neck 230 of the container 211 until the bottle 300 prevents axial movement of the cap 212A, and can rotate the cap 212A such that the threaded portions 244, 245 engage with the internal neck threads 242 to retain the cap 212A in a locked or secured configuration. The same is true of the cap 212B, as noted above.

Figure 14:
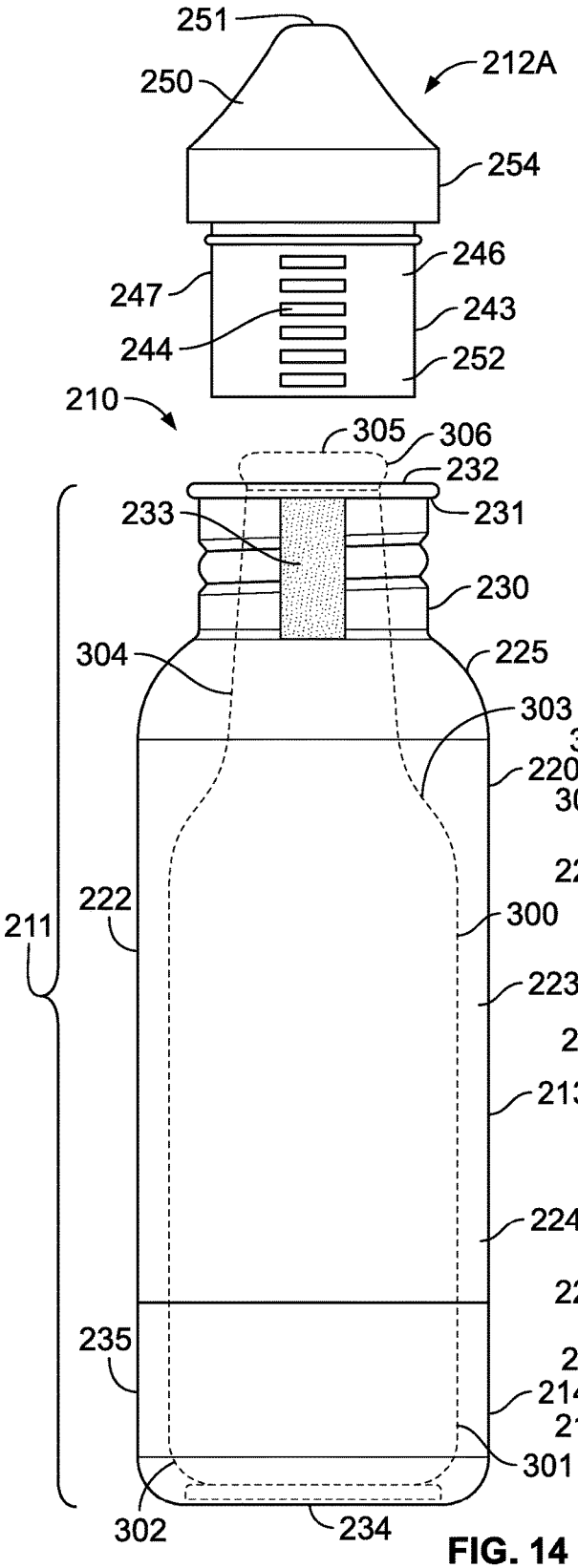
FIG. 14 is a side elevational view of the protective bottle enclosure of FIG. 5A in a first or open state, before the modified cap is inserted into a neck of the enclosure.
Figure 15:
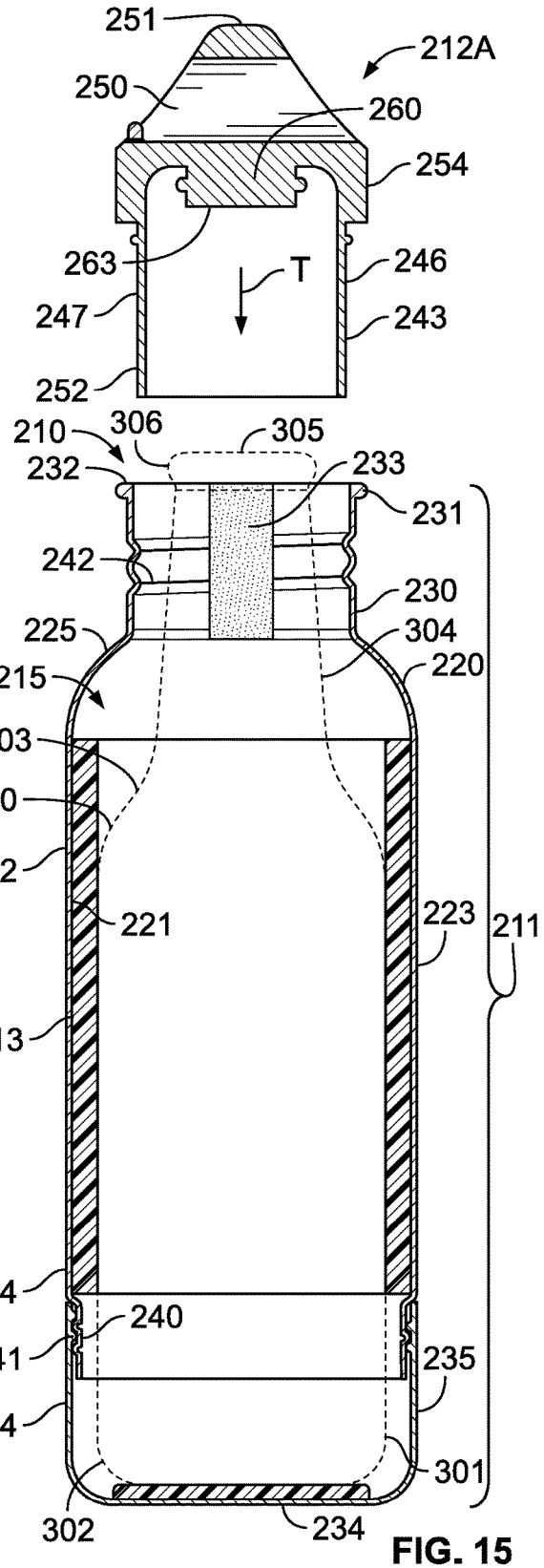
FIG. 15 is a sectional view of the enclosure of FIG. 14 taken through line 15-15 of FIG. 7.

Referring now to FIGS. 14 and 15, a first state is depicted wherein the cap 212A is ready to be inserted into the neck 230 of the container 211. The cap 212A is positioned such that the first and second threaded portions 244, 245 are aligned with the slots or planar portions 233 along the neck 230. FIG. 14 depicts the alignment of the threaded portion 244 with one of the slots 233, while the cross-sectional view of FIG. 15 depicts the uninterrupted portions 246, 247 being aligned with the internal threading 242 of the neck 230. Once the first and second threaded portions 244, 245 are aligned with the slots 233, the cap 212A is inserted downward, in the direction of arrow T. The bottle 300 is shown in broken lines to provide context as to how the stopper 260 aligns with the mouth 305 of the bottle 300.

Figure 16:
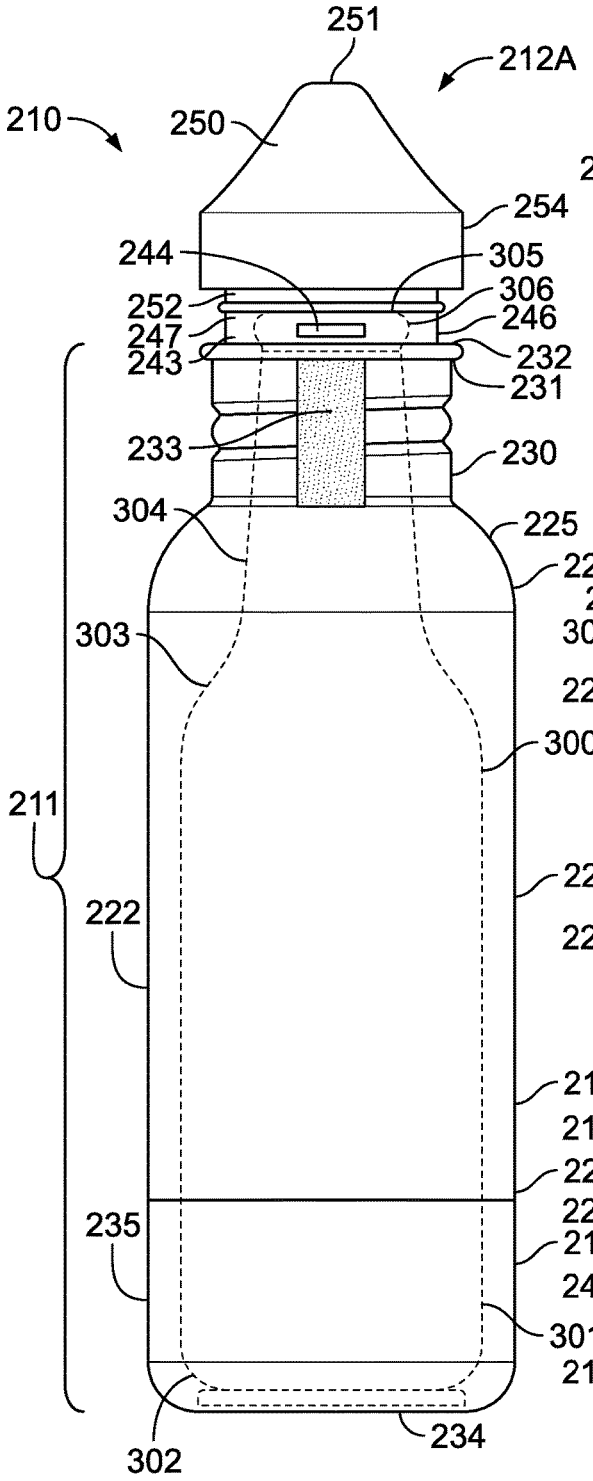
FIG. 16 is a side elevational view of the protective bottle enclosure of FIG. 5A in a second or partially inserted state, while the modified cap is being inserted into the neck of the enclosure.
Figure 17:
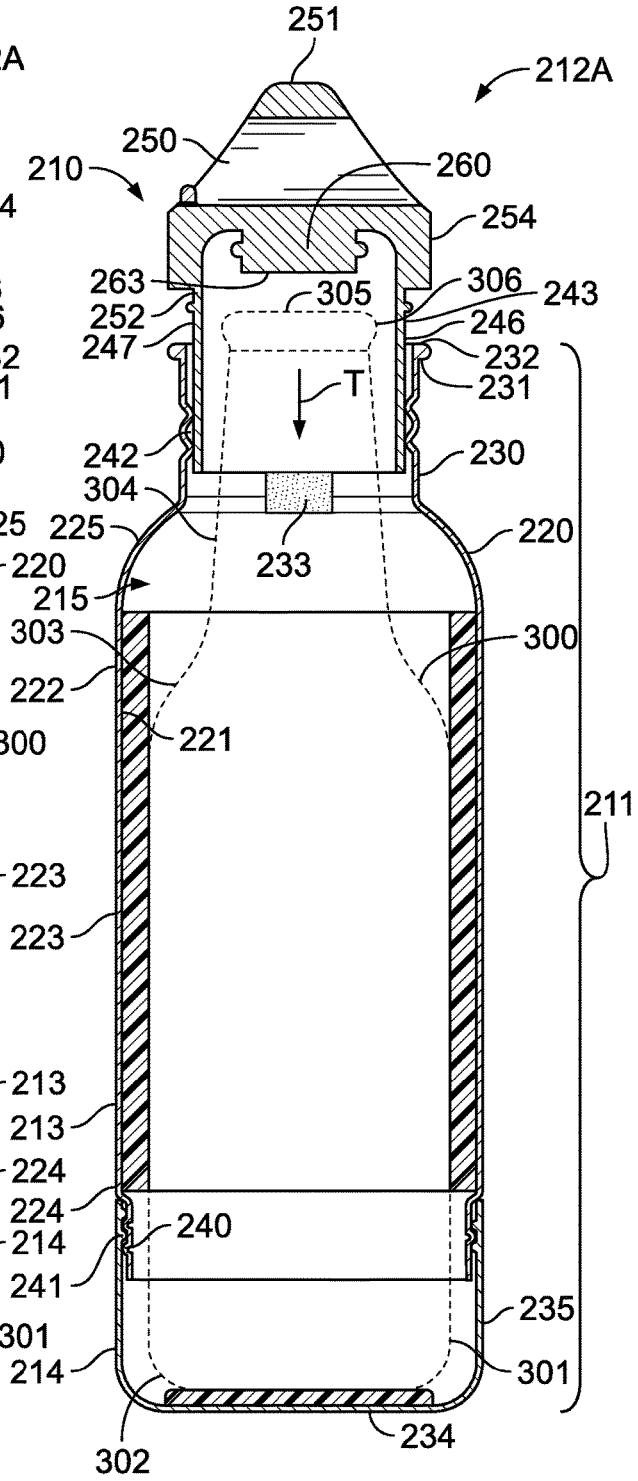
FIG. 17 is a sectional view of the enclosure of FIG. 16 taken through line 17-17 of FIG. 7.

Referring now to FIGS. 16 and 17, a second state is depicted, wherein the cap 212 has been partially inserted into the neck 230 of the container 211. The cap 212A remains in a configuration where the threaded portions 244, 245 are aligned with the slots 233 along the neck 230. FIG. 16 depicts the alignment of the threaded portion 244 with one of the slots 233, while the cross-sectional view of FIG. 17 depicts the uninterrupted portions 246, 247 being aligned with the internal threading 242 of the neck 230. As provided in FIG. 17, the sidewall 243 of the cap 212A is capable of sliding past the internal threading 242 along the neck 230 of the container 211 without interference while the threaded portions 244, 245 are slid within the slots 233. As noted above, the cap 212A is inserted downward in the direction of arrow T until the stopper 260 is aligned and in contact with the mouth 305 of the bottle 300.

Figure 18:
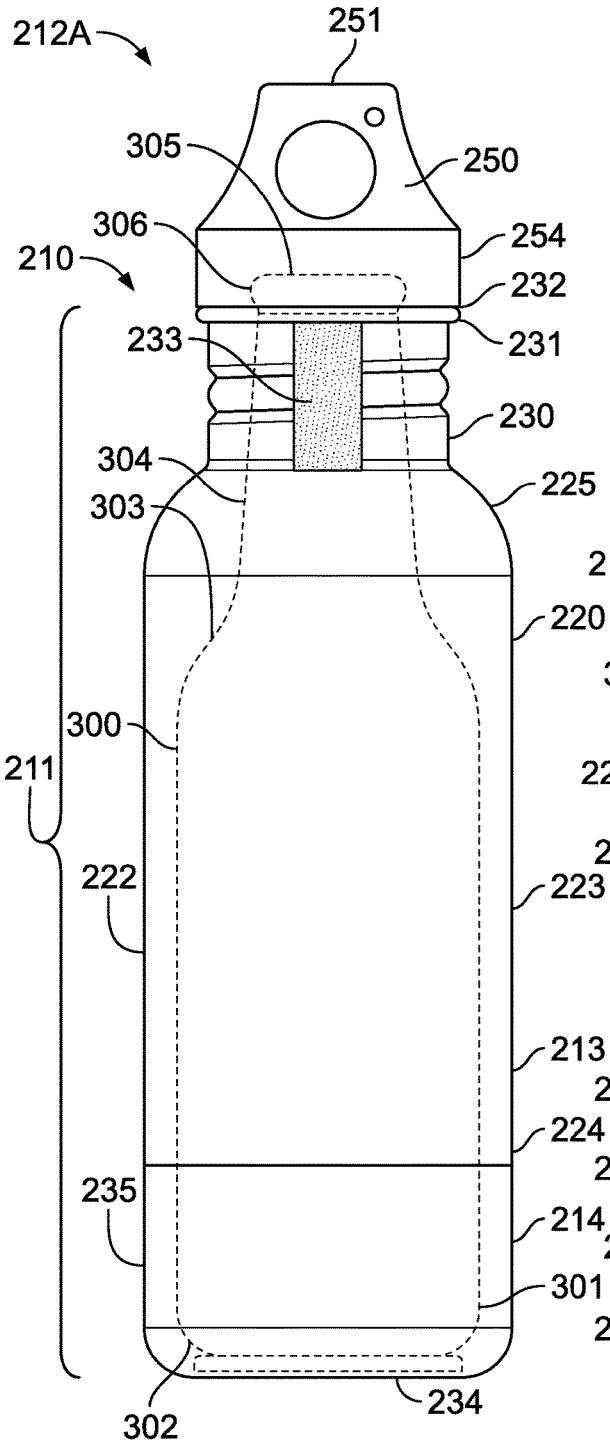
FIG. 18 is a side elevational view of the protective bottle enclosure of FIG. 5A in a third or closed state, after the modified cap has been inserted into the neck of the enclosure and rotated 90 degrees.
Figure 19:
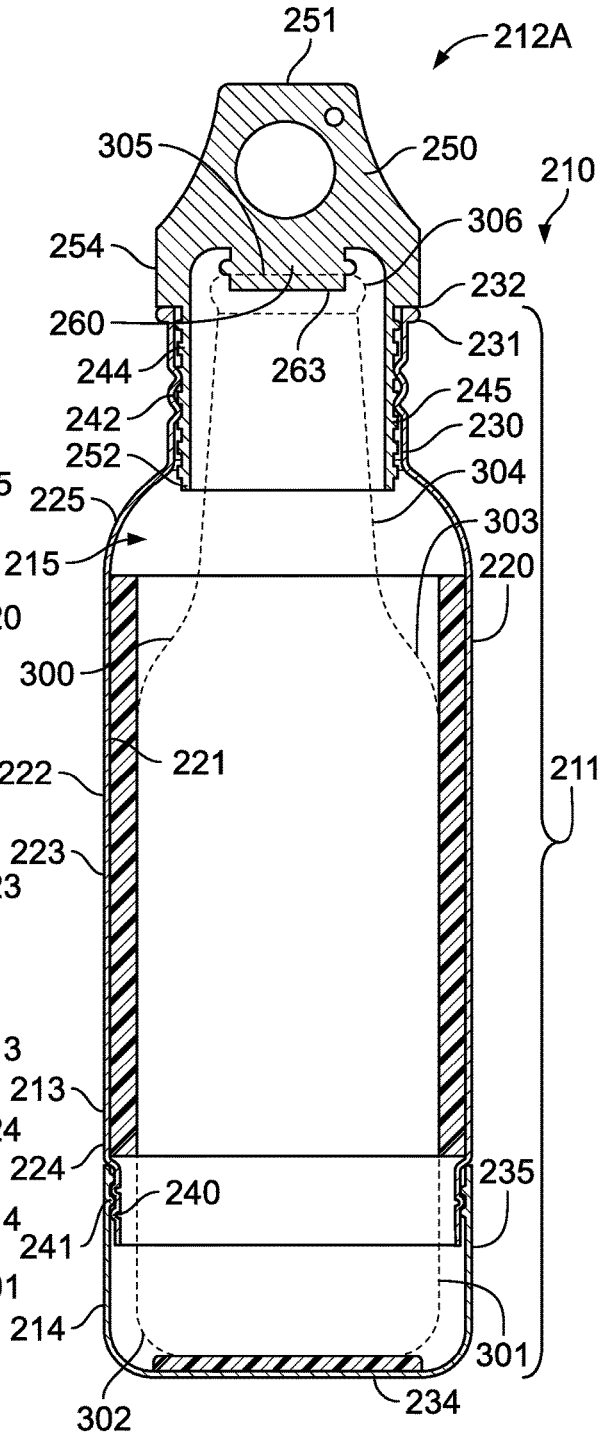
FIG. 19 is a sectional view of the enclosure of FIG. 18 taken through line 19-19 of FIG. 7.

Referring now to FIGS. 18 and 19, a third state is depicted, wherein the cap 212 has been fully seated on the bottle 300 and is fully engaged with the container 211. In some embodiments, the cuff 254 of the cap 212 is not fully seated against the annular lip 232, rather, once engagement with the bottle 300 has occurred, the cuff 254 of the cap 212 may be spaced from the lip 232. Regardless, once axial movement of the cap 212A in the direction of arrow T has ceased because of engagement between the mouth 305 of the bottle 300 and the stopper 260, the cap 212 is ready to be rotated clockwise by a user to fully engage the cap 212 with the container 211 to secure the bottle 300 as further discussed below.

Referring to FIG. 18, the cap 212A is depicted fully seated on the container 211 with the cap 212A having been rotated 90 degrees counterclockwise to engage the threaded portions 244, 245 with the internal threading 242 of the neck 230. FIG. 19 depicts a cross-sectional view that illustrates the cap 212A in a fully seated configuration, where the threaded portions 244, 245 are threadably engaged with the internal threading 242 of the neck 230. As noted above, once the stopper 260 is physically engaged with the mouth 305 of the cap 212A, the caps 212A, 212B may be rotated between 10 and 170 degrees, or between 25 and 155 degrees, or between 40 and 140 degrees, or between 60 and 120 degrees, or 90 degrees to fully secure the caps 212A, 212B with the neck 230. In some embodiments, the cap 212 may be rotated more than 180 degrees to fully secure the cap 212 with the neck 230, however, due to the configuration of the threading along the cap 212, in a preferred embodiment the cap 212 need only be rotated less than 180 degrees to secure the cap 212 with the neck 230. In some embodiments, the cap 212A need only be turned 10 degrees to engage the cap 212A with the container 211.

In this applied condition of the cap 212, the cap 212 forms a fluid-permeable seal with the container 211. As the cap 212 is still further threaded onto the container 211, however, the stopper 260 fills the entire mouth 305 of the bottle 300, and begins to be compressed and constricted radially by the mouth 305. The stopper 260 may be similar to any of the stoppers described above with respect to the caps 12, 12', and 12", and need not be limited to the embodiment depicted in FIGS. 5-19. Once the enclosure 210 is sealed with the cap 212, the bottle 300 can be carried, tilted, or tipped without spilling the beverage within the bottle 300 inside the enclosure 210. The cap 212 can be removed to allow a person to drink from the bottle 300, simply by unthreading the cap 212 from the container 211 and moving the cap 212 into the free condition thereof, exposing the mouth 305 of the bottle 300 that is spaced above the lip 232 of the upper portion 213 of the container 211.

The present disclosure is described above with reference to several embodiments. However, those having ordinary skill in the art will appreciate that changes and modifications may be made in the described embodiments without departing from the nature and scope of the present disclosure. Various further changes and modifications to the embodiments herein chosen for purposes of illustration will readily occur to one having ordinary skill in the art. To the extent that such modifications and variations do not depart from the principle of the disclosure, they are intended to be included within the scope thereof.

What is claimed is:

1. A protective bottle enclosure, comprising:

a container defining a longitudinal axis and comprising an upper portion and a base configured to be removably coupled to the upper portion, the upper portion extending from a top opening at a first end through a neck, a shoulder, and a body to a bottom section including a bottom opening at a second end opposite the first end, wherein the upper portion includes an interior cavity that extends from the top opening to the bottom opening, and wherein the neck includes a plurality of threaded portions and a plurality of non-threaded portions located intermediate the plurality of threaded portions; and a removable cap including an underside and a sidewall together defining an interior cavity, the sidewall including a first threaded portion and a second threaded portion extending therefrom, the first and second threaded portions being located along opposing sides of the sidewall, and a first uninterrupted portion and a second uninterrupted portion disposed adjacent and between the first and second threaded portions, wherein the first and second uninterrupted portions of the removable cap are axially aligned with the plurality of threaded portions of the neck when the removable cap is inserted into the neck of the container, wherein a midpoint of the first threaded portion is 180 degrees offset from a midpoint of the second threaded portion about the longitudinal axis, and wherein the underside of the removable cap includes a stopper body that is configured to be compressed radially and extends into the interior cavity that is configured to be received inside an open mouth of a beverage container.

2. The protective bottle enclosure of claim 1, wherein the first and second threaded portions of the removable cap are integrally molded with the sidewall of the removable cap.

3. The protective bottle enclosure of claim 1, wherein the neck includes at least two non-threaded portions and at least two threaded portions.

4. The protective bottle enclosure of claim 1, further comprising a ring extending radially outward from the stopper body and configured to form a seal with the open mouth of the beverage container.

5. The protective bottle enclosure of claim 4, wherein an inner surface of the sidewall of the removable cap defines a first diameter and the stopper body defines a second diameter that is smaller than the first diameter.

6. The protective bottle enclosure of claim 4, wherein the ring is constructed from a compressible material.

7. The protective bottle enclosure of claim 1, wherein the base is threadably coupled with the second end of the upper portion.

8. A protective bottle enclosure, comprising:

a container defining a longitudinal axis and comprising:

an upper portion that extends from a top opening at an upper end through a neck, a shoulder, and a body to a bottom section including a bottom opening at a lower end, wherein the neck includes at least one threaded portion and at least one non-threaded portion; and a base configured to be removably coupled to the upper portion, the base having a bottom surface and a sidewall extending from the bottom surface, the base being removably coupled with the lower end of the body; and a removable cap including a top wall and a sidewall extending from the top wall, wherein the sidewall includes a first cap threaded portion and a second cap threaded portion extending from the sidewall and a first cap uninterrupted portion disposed between the first cap threaded portion and the second cap threaded portion, wherein the top wall of the removable cap includes a stopper extending therefrom and configured to be inserted into an opening formed by a mouth of a bottle, wherein the removable cap is configured to be axially inserted into the neck until a ring flange extending radially outward from the stopper engages with the mouth of the bottle to be disposed within the container, and wherein the removable cap is in a fully sealed configuration upon rotation of the removable cap by less than 180 degrees once the ring flange has engaged with the mouth.

9. The protective bottle enclosure of claim 8 further comprising a second cap uninterrupted portion disposed between the first cap threaded portion and the second cap threaded portion along the removable cap, wherein the at least one threaded portion of the neck includes a plurality of threaded portions and the at least one non-threaded portion of the neck includes a plurality of non-threaded portions, and wherein the first and second cap threaded portions are capable of insertion into the neck when aligned with the plurality of non-threaded portions of the neck.

10. The protective bottle enclosure of claim 8, wherein the neck includes at least two non-threaded portions.

11. The protective bottle enclosure of claim 8, wherein the ring flange is constructed from a compressible material.

12. The protective bottle enclosure of claim 8, wherein the removable cap is in the fully sealed configuration upon rotation of the removable cap by less than 120 degrees once the ring flange of the stopper has engaged with the mouth.

13. A cap for a protective bottle enclosure, comprising:

a knob that is formed with a tab that can be gripped and rotated;

a collar defining a longitudinal axis and depending from an underside of the knob opposite the tab and being defined by a sidewall, wherein the underside of the knob and the sidewall together define an interior cavity;

a stopper body disposed within the interior cavity and configured to be compressed radially and inserted into an opening formed by a mouth of a bottle;

a first threaded portion that extends outwardly from the sidewall;

a second threaded portion that extends outwardly from the sidewall;

a first uninterrupted portion of the sidewall disposed between the first threaded portion and the second threaded portion; and a second uninterrupted portion of the sidewall disposed between the first threaded portion and the second threaded portion, wherein a midpoint of the first threaded portion is 180 degrees offset from a midpoint of the second threaded portion about the longitudinal axis.

14. The cap of claim 13, wherein the stopper body is integrally molded with the underside of the knob.

15. The cap of claim 13 further comprising a ring flange extending radially outward from the stopper body and configured to form a seal with the mouth of the bottle.

16. The cap of claim 13, wherein the knob, the collar, the stopper body, the first threaded portion, and the second threaded portion are unitary and formed of the same material.

17. The cap of claim 13, wherein the cap is capable of being inserted axially into a neck of a container and is further capable of sealing the container by rotating the cap less than 180 degrees.

18. The protective bottle enclosure of claim 8, wherein the removable cap, the upper portion, and the base are provided to insulate and protect a bottle.

19. The protective bottle enclosure of claim 8, wherein an inner surface of the sidewall of the removable cap defines a first diameter and the stopper defines a second diameter that is smaller than the first diameter.

20. The protective bottle enclosure of claim 8, wherein the top wall, sidewall, and stopper are unitary and formed of the same material.

* * * * *